US011407570B2

(12) United States Patent
Kirchhoff

(10) Patent No.: US 11,407,570 B2
(45) Date of Patent: Aug. 9, 2022

(54) CARTON COMPRISING AN EXPENDIBLE HANDLE AND BLANK THEREFOR

(71) Applicant: WestRock Packaging Systems, LLC, Atlanta, GA (US)

(72) Inventor: Amy L. Kirchhoff, New South Wales (AU)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 121 days.

(21) Appl. No.: 16/769,468

(22) PCT Filed: Dec. 4, 2018

(86) PCT No.: PCT/US2018/063725
§ 371 (c)(1),
(2) Date: Jun. 3, 2020

(87) PCT Pub. No.: WO2019/112989
PCT Pub. Date: Jun. 13, 2019

(65) Prior Publication Data

US 2020/0385187 A1 Dec. 10, 2020

Related U.S. Application Data

(60) Provisional application No. 62/594,090, filed on Dec. 4, 2017.

(51) Int. Cl.
*B65D 71/30* (2006.01)

(52) U.S. Cl.
CPC ..... *B65D 71/30* (2013.01); *B65D 2571/0066* (2013.01); *B65D 2571/00141* (2013.01);
(Continued)

(58) Field of Classification Search
CPC ..... B65D 71/26; B65D 71/30; B65D 2571/00141; B65D 2571/00277;
(Continued)

(56) References Cited

U.S. PATENT DOCUMENTS 2,034,679 A * 3/1936 Kundts ..... B65D 71/0014 229/117.14
2,354,528 A 7/1944 Lowey et al.
(Continued)

FOREIGN PATENT DOCUMENTS

EP 1513737 B1 11/2006
JP 1977012127 U 1/1977
(Continued)

*Primary Examiner* — Bryon P Gehman
(74) *Attorney, Agent, or Firm* — Neil G. Cohen; Brian J. Goldberg

(57) ABSTRACT

A carton for packaging one or more articles includes an extendible handle. The handle includes at least one handle panel and a collapsible structure. The collapsible structure couples the at least one handle panel to a main body of the carton. The collapsible structure comprises a pair of hinged panels. The hinged panels include an inner panel hingedly connected by a first fold line to an outer panel. The inner panel is hingedly connected to the main body of the carton. The outer panel is hingedly connected to the at least one handle panel. The collapsible tubular structure further includes an expansion facilitator which has at least one tab coupled to one of the inner and outer panels. The at least one tab interrupts the first fold line.

20 Claims, 16 Drawing Sheets

(52) U.S. Cl.
CPC ..... *B65D 2571/00277* (2013.01); *B65D 2571/00456* (2013.01); *B65D 2571/00512* (2013.01); *B65D 2571/00716* (2013.01)

(58) Field of Classification Search
CPC ..... B65D 2571/00456; B65D 2571/00512; B65D 2571/0066; B65D 2571/00716
USPC ..... 206/141, 426
See application file for complete search history.

(56) References Cited

U.S. PATENT DOCUMENTS

| | | | |
|---|---|---|---|
| 2,462,676 | A | 2/1949 | Riley et al. |
| 3,069,979 | A | 12/1962 | Charles et al. |
| 2009/0121001 | A1 | 5/2009 | Perez et al. |
| 2014/0166519 | A1 | 6/2014 | O'Neal |

FOREIGN PATENT DOCUMENTS

| | | | |
|---|---|---|---|
| WO | WO03/106288 | A1 | 12/2003 |
| WO | WO2018/031555 | A1 | 2/2018 |

* cited by examiner

CARTON COMPRISING AN EXPENDIBLE HANDLE AND BLANK THEREFOR

CROSS-REFERENCE TO RELATED APPLICATIONS

This application is a National Phase application of PCT Application PCT/US18/63725, filed Dec. 4, 2018, which claims the benefit of U.S. Provisional Patent Application No. 62/594,090, filed Dec. 4, 2017, which is incorporated herein by reference in its entirety.

TECHNICAL FIELD

The present invention relates to handle structure for a carton, to cartons and to blanks for forming the same. More specifically, but not exclusively, the invention relates to a carton having a retractable handle structure and to a tubular structure having an expansion facilitator.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is desirable to provide cartons with a carrying handle such that a consumer can readily transport the carton. It is desirable that the handle is retractable such that the carton can be stacked with other cartons for distribution of the packages to points of sale.

The present invention seeks to provide an improvement in the field of cartons, typically formed from paperboard or the like.

SUMMARY

A first aspect of the invention provides a carton for packaging one or more articles. The carton comprises an extendible handle comprising at least one handle panel and a collapsible structure. The collapsible tubular structure couples the at least one handle panel to a main body of the carton. The collapsible tubular structure comprises a first pair of hinged panels and a second pair of hinged panels. The first pair of hinged panels comprises an inner panel hingedly connected by a first fold line to an outer panel. The second pair of hinged panels comprises an inner panel hingedly connected by a second fold line to an outer panel. The inner panels are hingedly connected to the main body of the carton. The outer panels are hingedly connected to the at least one handle panel. The collapsible tubular structure further comprises an expansion facilitator for facilitating separation movement of the first pair of hinged panels from the second pair of hinged panels. The expansion facilitator comprises at least one tab coupled to one of the inner and outer panels of each of the first and second pairs of hinged panels. The at least one tab of the first pair of hinged panels interrupts the first fold line. The at least one tab of the second pair of hinged panels interrupts the second fold line.

Optionally, the carton comprises a plurality of walls including; a top wall, a first side wall, a second side wall and a base wall, the plurality of walls forming the main body of the carton.

Optionally, the handle is movable between a retracted position and an extended position.

Optionally, the carton body includes at least one partition panel and at least one end panel.

Optionally, at least one end panel is hingedly connected to one of the first and second side walls.

Optionally, at least one partition panel is hingedly connected to the at least one end panel.

Optionally, the collapsible tubular structure defines a tubular axis and the at least one tab of the first pair of hinged panels is offset in the direction of the tubular axis from the at least one tab of the second pair of hinged panels.

Optionally, the at least one tab of the first pair of hinged panels is joined to the inner panel of the first pair of hinged panels.

Optionally, the at least one tab of the second pair of hinged panels is joined to the inner panel of the second pair of hinged panels.

Optionally, the at least one tab of the second pair of hinged panels is joined to the outer panel of the second pair of hinged panels.

Optionally, the at least one tab of the first pair of hinged panels is integral with the inner panel of the first pair of hinged panels.

Optionally, the at least one tab of the second pair of hinged panels is integral with the inner panel of the second pair of hinged panels.

Optionally, the at least one tab of the second pair of hinged panels is integral with the outer panel of the second pair of hinged panels.

A second aspect of the invention provides a carton having an extendible handle, the carton comprising a plurality of walls forming a carton body, the body of the carton comprises an outer shell defining at least in part the interior of the carton for receiving articles, the handle comprising at least one handle panel and a collapsible structure, wherein the collapsible tubular structure comprises a pair of panels including an inner panel hingedly connected by a fold line to an outer panel, the inner panel is hingedly connected to the main body of the carton by a hinged connection, the outer panel is hingedly connected to the at least one handle panel, the hinged connection between the inner panel and the carton body is disposed inside the interior of the carton such that the collapsible structure may be brought into engagement with one or more articles in the carton when the handle is in a retracted position.

Optionally, the plurality of walls includes; a top wall, a first side wall, a second side wall and a base wall.

Optionally, the hinged connection is disposed below an upper edge of the outer shell-forming section when the handle H is in use.

Optionally, the upper edge is a free edge at an open end of the outer shell-forming section.

Optionally, the collapsible structure is disposed in a space or void between two adjacent articles when the handle is in the retracted position.

Optionally, the collapsible structure comprises an article engaging feature for locking the handle in the retracted position.

Optionally, the article engaging feature comprises one of the elements selected from the group consisting of: at least one engaging tab; at least one embossment protruding from the outer panel; at least one dot or strip of friction material on the outer panel; fugitive glue on the outer panel and friction tape on the outer panel.

A third aspect of the invention provides a blank for forming a carton, the blank comprising a plurality of panels forming a main body of the carton in set-up condition, the plurality of panels including; a top panel, a first side panel, a second side panel and a base panel, the blank comprising an extendible handle, the handle comprising at least one handle panel and a collapsible structure, the collapsible tubular structure coupling the at least one handle panel to one of the plurality of panels forming the main body of the carton, the collapsible tubular structure comprising a first pair of hinged panels and a second pair of hinged panels, the first pair of hinged panels comprising an inner panel hingedly connected by a first fold line to an outer panel, the second pair of hinged panels comprising an inner panel hingedly connected by a second fold line to an outer panel, wherein the inner panels are hingedly connected a respective one of the plurality of panels forming the main body of the carton, the outer panels being hingedly connected to the at least one handle panel, wherein the collapsible tubular structure further comprises an expansion facilitator for facilitating separation movement of the first pair of hinged panels from the second pair of hinged panels, the expansion facilitator comprises at least one tab coupled to one of the inner and outer panels of each of the first and second pairs of hinged panels, the at least one tab of the first pair of hinged panels interrupts the first fold line, the at least one tab of the second pair of hinged panels interrupts the second fold line.

A fourth aspect of the invention provides a blank for forming a carton, the blank comprising a plurality of panels forming a carton body having an outer shell defining at least in part the interior of the carton for receiving articles in a set-up condition, the plurality of panels including; a top panel, a first side panel, a second side panel and a base panel, wherein the blank comprises an extendible handle, the handle comprising at least one handle panel and a collapsible structure, wherein the collapsible tubular structure comprises a pair of panels including an inner panel hingedly connected by a fold line to an outer panel, the inner panel is hingedly connected to one of the plurality of panels forming the carton body by a hinged connection, the outer panel is hingedly connected to the at least one handle panel, the hinged connection between the inner panel and said one of the plurality of panels is configured to be disposed inside the interior of a set-up carton such that the collapsible structure may be brought into engagement with one or more articles in the carton when the handle is in a retracted position.

A fifth aspect of the invention provides an extendible handle for a carton. The extendible handle comprises at least one handle panel and a collapsible structure. The collapsible tubular structure couples the at least one handle panel to a main body of a carton. The collapsible tubular structure comprises a first pair of hinged panels and a second pair of hinged panels. The first pair of hinged panels comprises an inner panel hingedly connected by a first fold line to an outer panel. The second pair of hinged panels comprises an inner panel hingedly connected by a second fold line to an outer panel. The inner panels are hingedly connected to the main body of the carton. The outer panels are hingedly connected to the at least one handle panel. The collapsible tubular structure further comprises an expansion facilitator for facilitating separation movement of the first pair of hinged panels from the second pair of hinged panels. The expansion facilitator comprises at least one tab coupled to one of the inner and outer panels of each of the first and second pairs of hinged panels. The at least one tab of the first pair of hinged panels interrupts the first fold line. The at least one tab of the second pair of hinged panels interrupts the second fold line.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
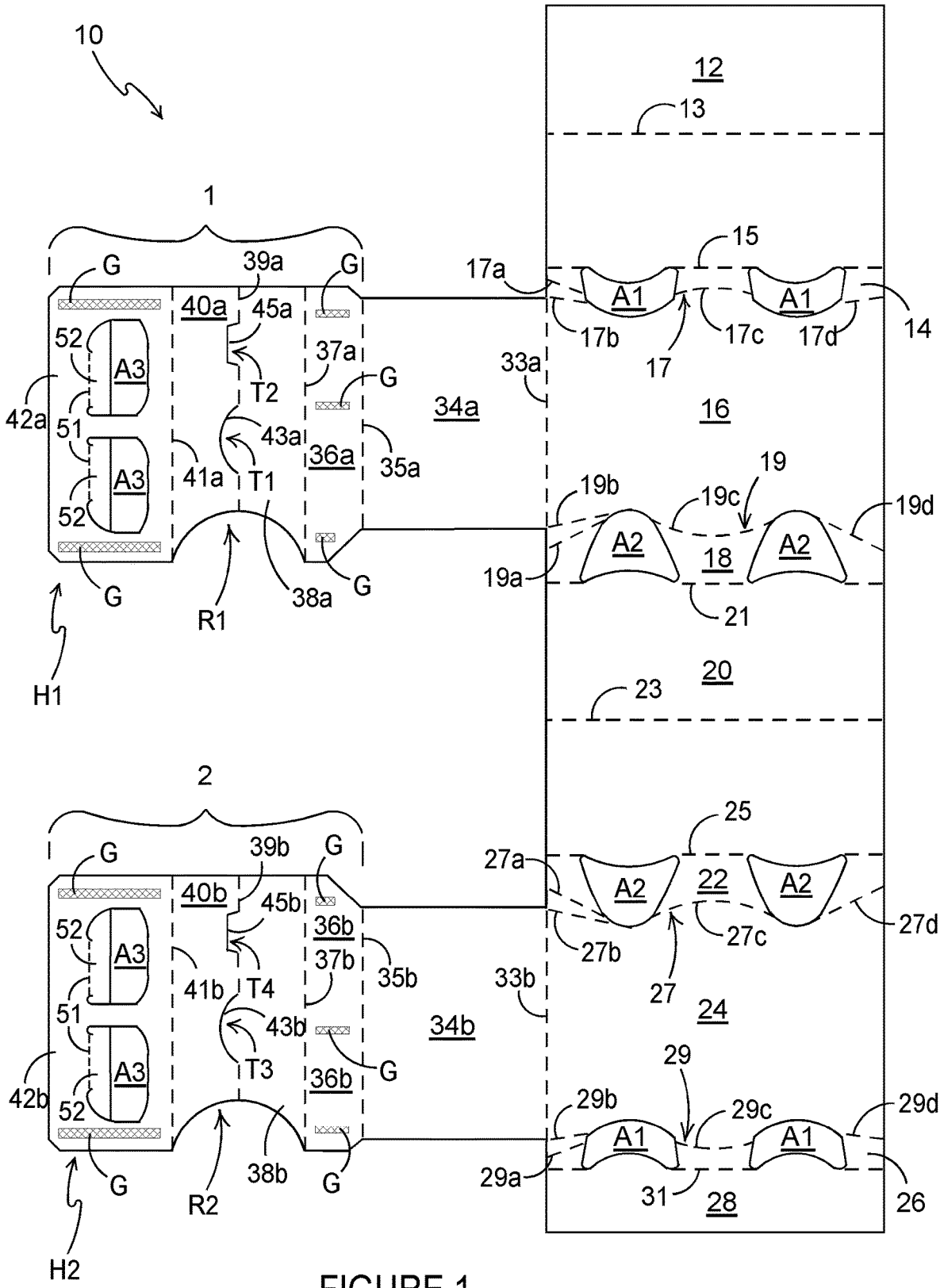
FIG. 1 is a plan view from above of a blank for forming a carton according to a first embodiment.
Figure 2:
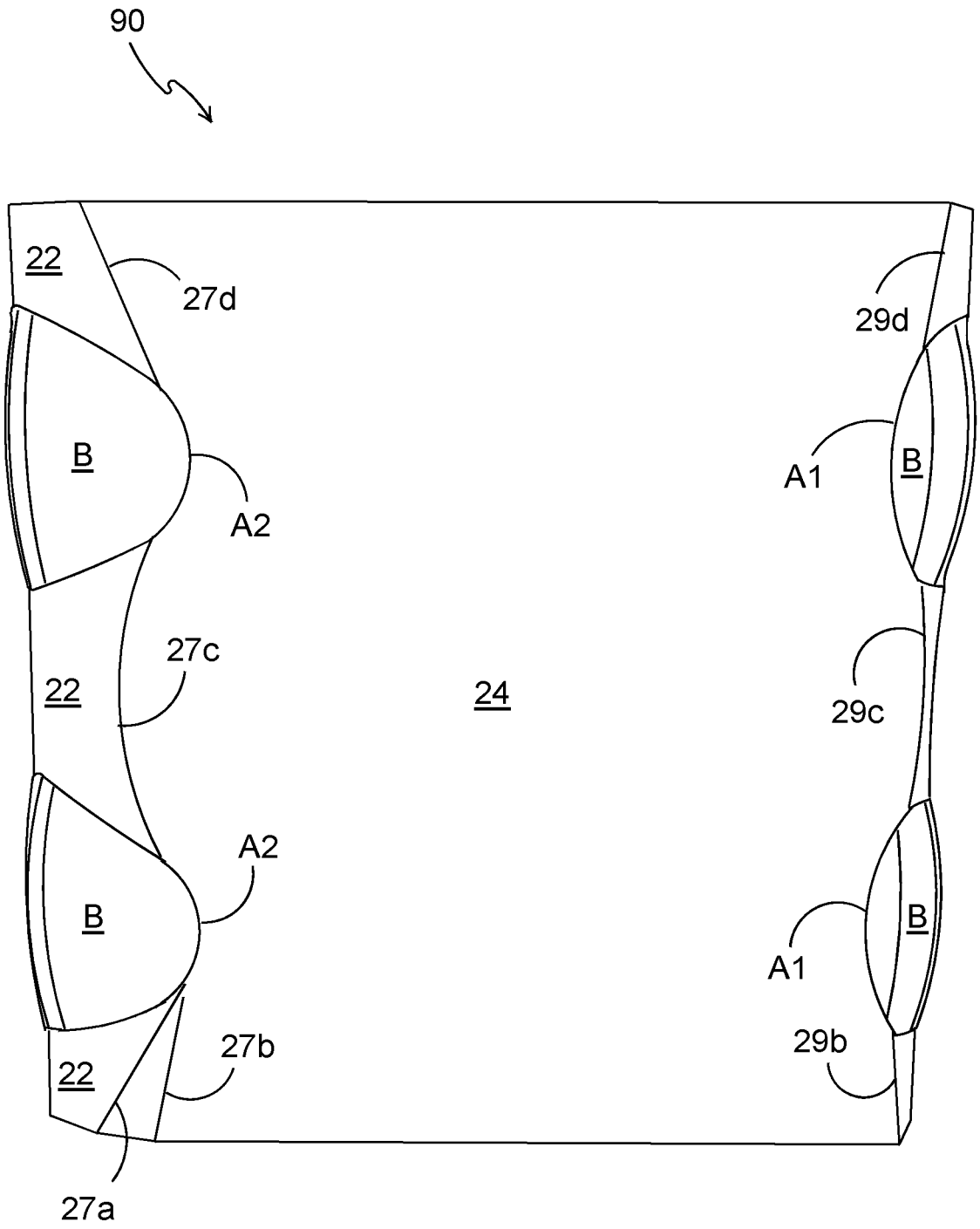
FIG. 2 is a side view of a carton formed from the blank of FIG. 1.

Referring to FIG. 1, there is shown a plan view of a blank 10 capable of forming a carton or carrier 90, as shown in FIG. 2, for containing and carrying a group of primary products such as, but not limited to, beverage cans, hereinafter referred to as articles B, as shown in FIG. 2. The blank 10 forms a secondary package for packaging at least one primary product container or package.

FIGS. 6, 7, 8 and 11 each show a plan view of a blank 110; 210; 310; 410 capable of forming a carton or carrier 190; 290; 390; 490 for containing and carrying a group of primary products such as, but not limited to, beverage cans, hereinafter referred to as articles B. The blanks 110; 210; 310; 410 form secondary packages for packaging at least one primary product container or package.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, cups, pots, pouches, packets and the like.

The blanks 10; 110; 210; 310; 410 are each formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the embodiment illustrated in FIG. 1, the blank 10 is configured to form a carton or carrier 90 for packaging an exemplary arrangement of exemplary articles B. In the illustrated embodiment the arrangement is an m×n matrix or array, having two rows (m=2) and two columns (n=2) such that the carton 90 comprises two rows of two articles B. The articles B may be 330 ml beverage cans.

Figure 6:
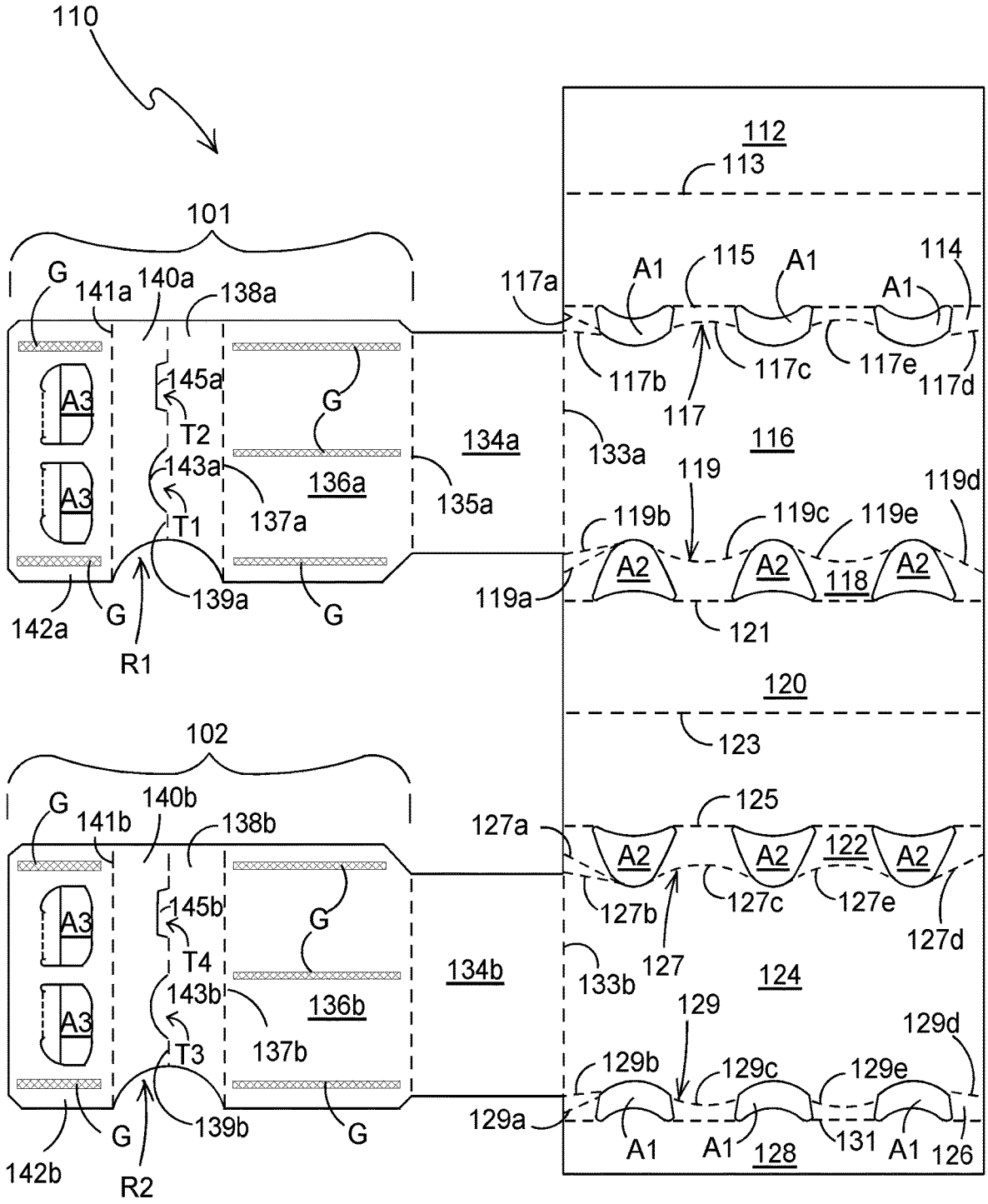
FIG. 6 is a plan view from above of a blank for forming a carton according to a second embodiment.

In the embodiment illustrated in FIG. 6, the blank 110 is configured to form a carton or carrier 190 for packaging an exemplary arrangement of exemplary articles B. In the illustrated embodiments, the arrangement is an m×n matrix or array, having two rows (m=2) and three columns (n=3). The blank 110 forms a carton 190 which accommodates two rows of three articles B and the articles B are 355 ml beverage cans.

Figure 9:
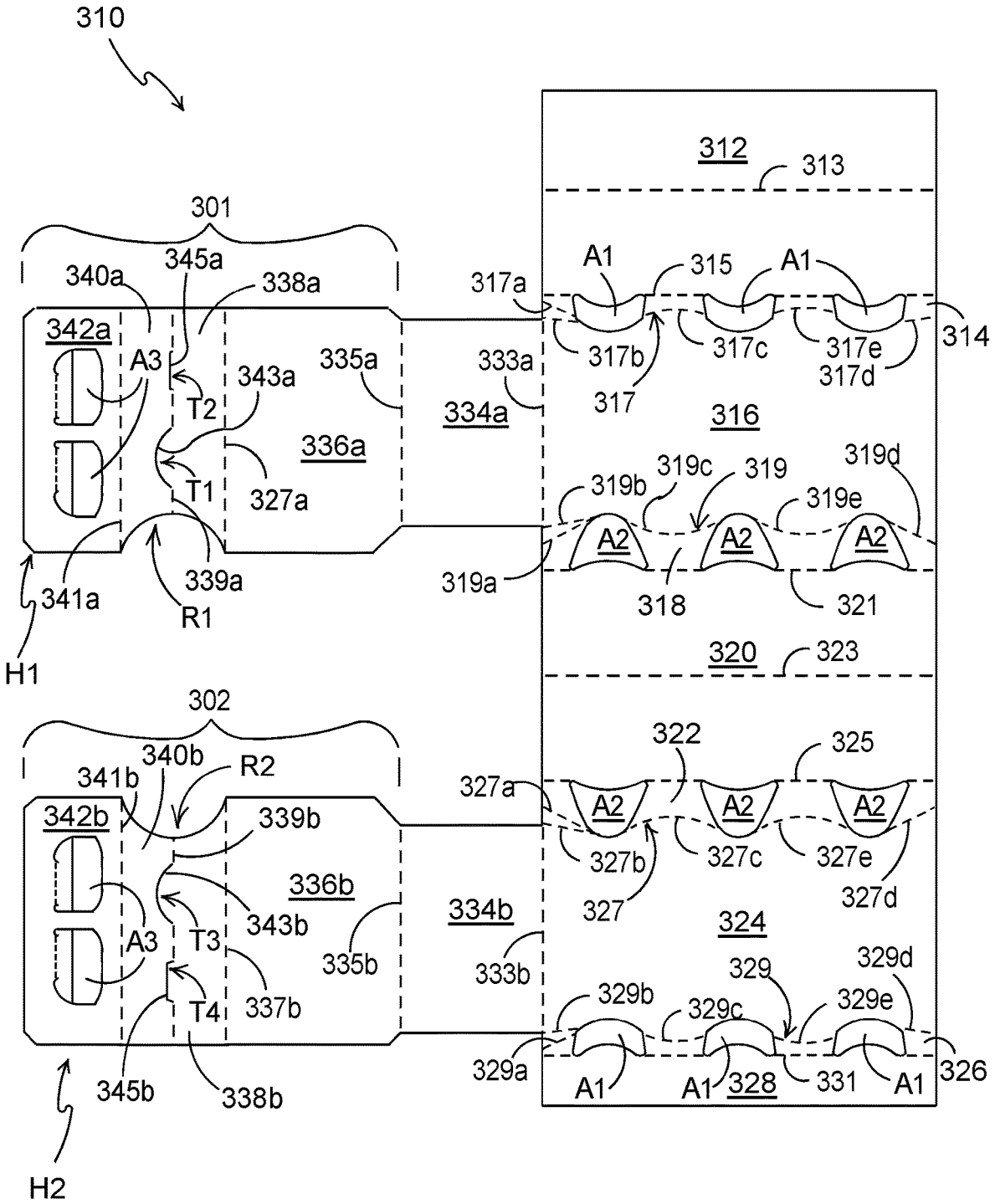
FIG. 9 is a plan view from above of a blank for forming a carton according to a fourth embodiment.
Figure 11:
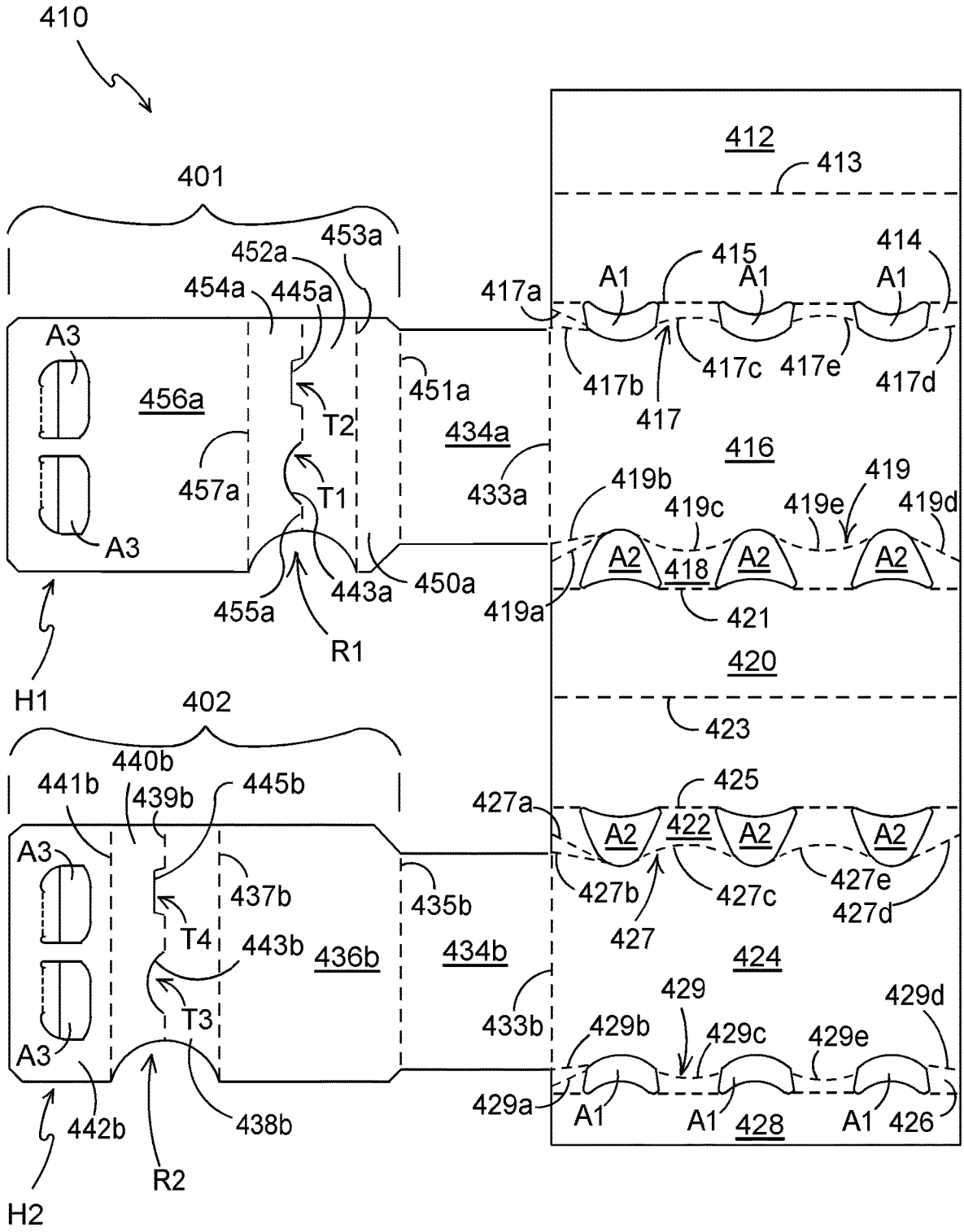
FIG. 11 is a plan view from above of a blank for forming a carton according to a fifth embodiment.
Figure 12:
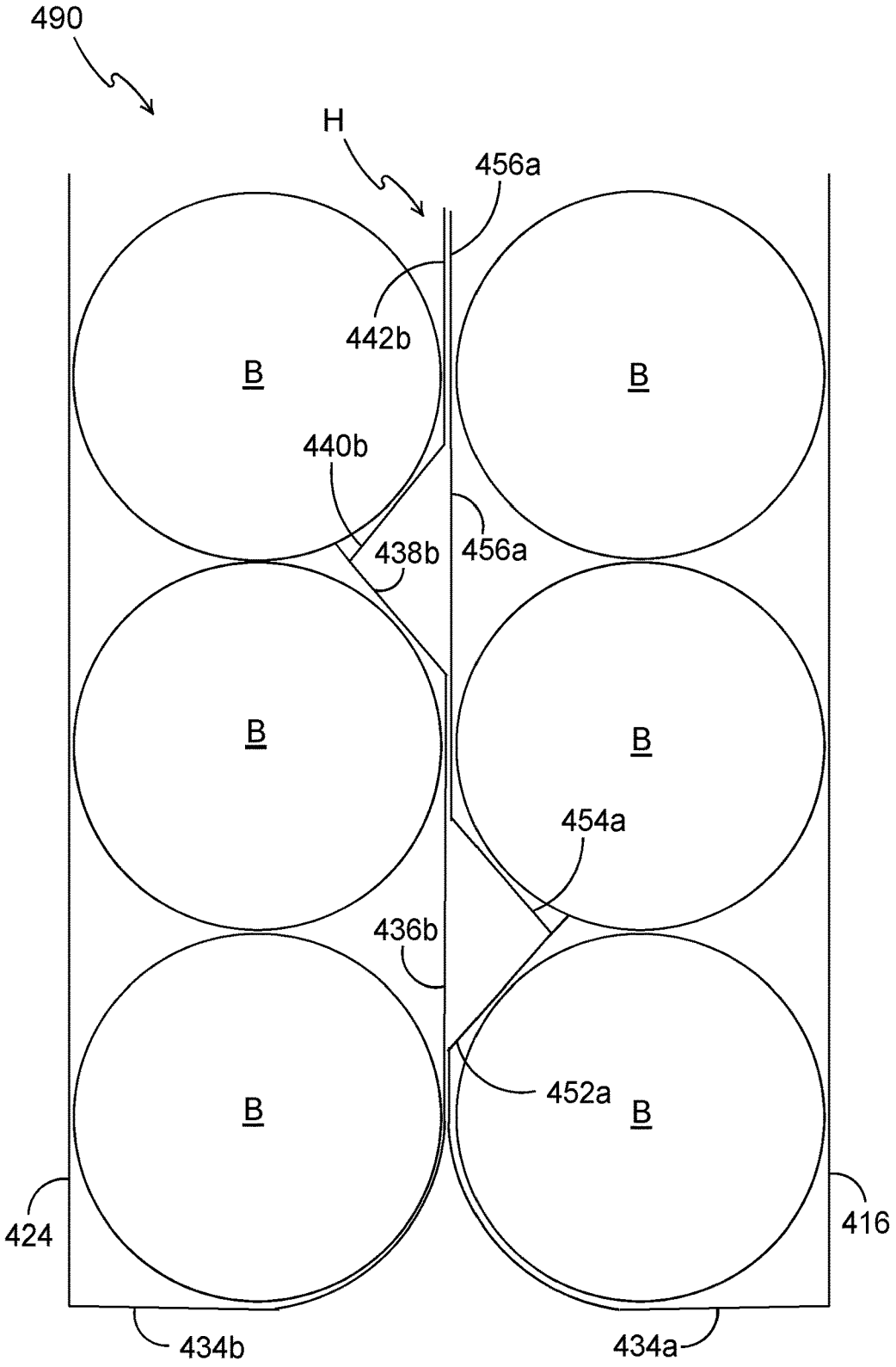
FIG. 12 is a sectional view of a carton formed from the blank of FIG. 11 showing a carrying handle in a stowed condition.

In the embodiment illustrated in FIGS. 9 and 11, the blanks 310; 410 are configured to form a carton or carrier 390; 490 for packaging an exemplary arrangement of exemplary articles B.

In the illustrated embodiments the arrangement is an m×n matrix or array, having two rows (m=2) and three columns (n=3). The cartons 390; 490 comprise two rows of three articles B and the articles B are 375 ml beverage cans.

Figure 7:
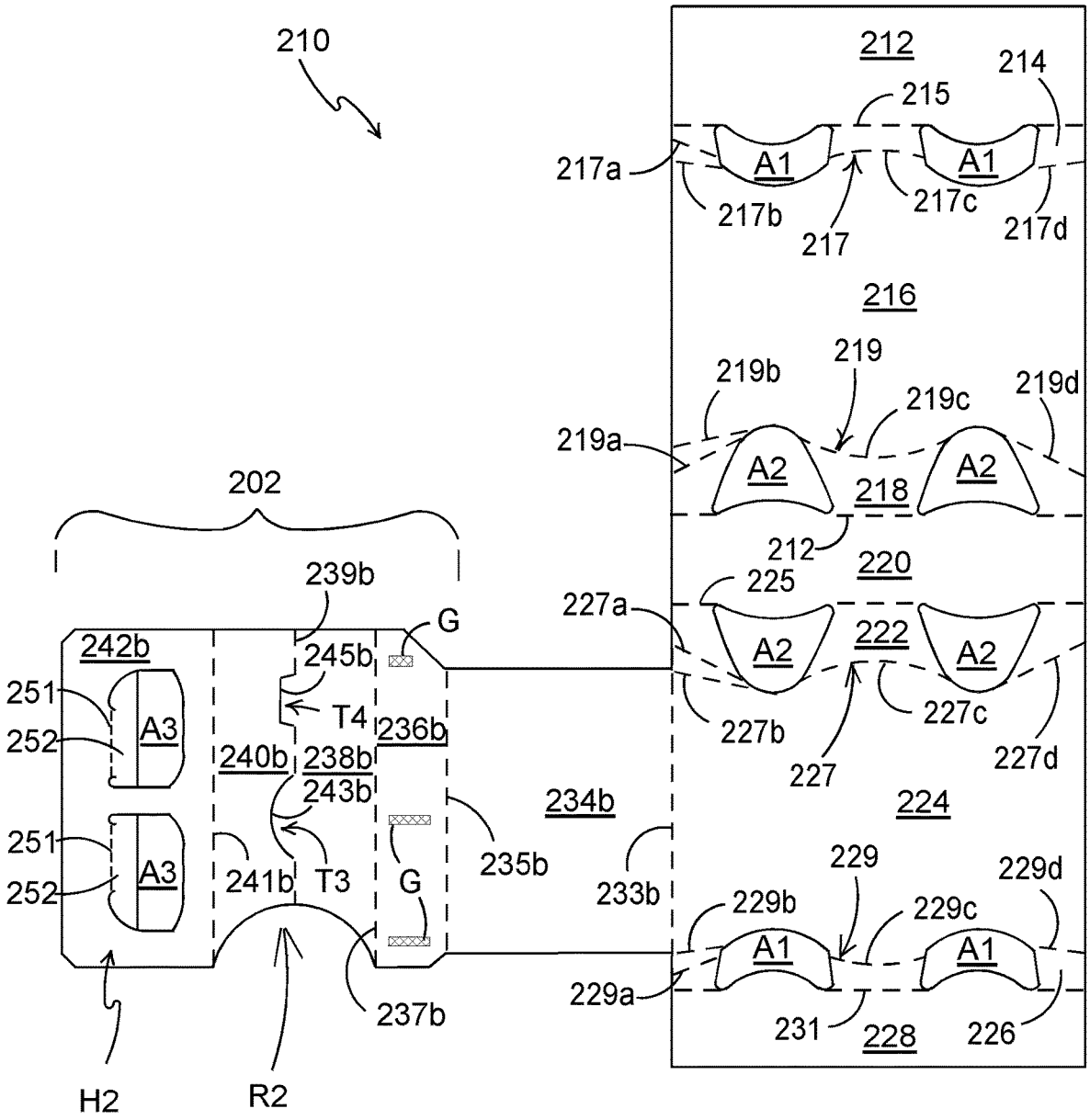
FIG. 7 is a plan view from above of a blank for forming a carton according to a third embodiment.

In the embodiment illustrated in FIG. 7, the blank 210 is configured to form a carton or carrier for packaging an exemplary arrangement of exemplary articles B. In the illustrated embodiment the arrangement is an m×n matrix or array, having one row (m=1) and two columns (n=2). The blank 210 forms a carton 290 which comprises one row of two articles B and the articles B are 330 ml beverage cans.

Alternatively, the blanks 10; 110; 210; 310; 410 can be configured to form a carrier for packaging other types, number and size of articles B and/or for packaging articles B in a different arrangement or configuration for example, but not limited to, fully enclosed cartons or basket carriers, the articles B may be bottles or cans.

Turning to FIG. 1, there is illustrated a blank 10 for forming a carton 90 (see FIG. 2) according to a first embodiment. The blank 10 comprises a plurality of main panels 12, 14, 16, 18, 20, 22, 24, 26, 28 for forming a tubular structure. The tubular structure forms a main body of the carton 90. The plurality of main panels 12, 14, 16, 18, 20, 22, 24, 26, 28 comprises a base panel 12, a first lower bevel panel 14, a first side panel 16, a first upper bevel panel 18, a top panel 20, a second upper bevel panel 22, a second side panel 24, a second lower bevel panel 26 and a securing panel 28. The plurality of panels 12, 14, 16, 18, 20, 22, 24, 26, 28 may be arranged in a linear series hinged one to the next by corresponding fold lines 15, 17, 19, 21, 25, 27, 29, 31.

In alternative embodiments, the first and second lower bevel panels 14, 26 may be omitted, the fold lines 17, 29 may be omitted. In alternative embodiments, the first and second upper bevel panels 18, 22 may be omitted, the fold lines 19, 27 may be omitted.

The first and second lower bevel panels 14, 26 may be considered to form lower portions of the respective one of the first or second side panels 16, 20 to which they are hingedly connected.

The first and second upper bevel panels 18, 22 may be considered to form upper portions of the respective one of the first or second side panels 16, 20 to which they are hingedly connected.

The blank 10 is foldable to form a package 90 as illustrated in FIG. 2. The base panel 12 is secured to the securing panel 28 in an overlapping relationship to form a composite base wall 12/28 of the carton 90. The base panel 12 and securing panel 28 may be secured to each other by an adhesive or a mechanical fastener such as staples or by other suitable securing mechanisms.

The base panel 12 may comprise an optional fold line 13 extending longitudinally thereacross. The fold line 13 may bisect the base panel 12.

The top panel 20 may comprise an optional fold line 23 extending longitudinally thereacross. The fold line 23 may bisect the top panel 20.

Optionally, the first and second lower bevel panels 14, 26 may comprise at least one heel engagement structure for engaging with a heel or lower portion of an article B. The blank 10 illustrated in FIG. 1 comprises four heel engagement structures each is provided for engaging a respective article B. Each of the heel engagement structures comprises an opening A1. The openings A1 are struck, at least, from one of the first and second lower bevel panels 14, 26. The openings A1 may be struck, in part, from one of the first and second lower bevel panels 14, 26 and in part from the one of the first and second side panels 16, 24. In other embodiments, the openings A1 may be struck from one of the first and second side panels 16, 24. The openings A1 may be struck in part from the base panel 12 or from the securing panel 28.

The heel engagement structures comprise protrusions formed from material which would otherwise form one of the first and second lower bevel panels 14, 26 or one of the first and second side panels 16, 24. The protrusions are integral with the base panel 12 or the securing panel 28. The protrusions form a tab which is disposed proximate to the base of an article B, and may be considered to form a part of the base wall of the carton 90. The tabs protect the base of the article B below which they are located.

The openings A1 of the heel engagement structures in the first lower bevel panel 14 interrupt the fold line 17 that couples the first lower bevel panel 14 to the first side panel 16. The fold line 17 comprises a first portion 17A and a second portion 17B which converge towards an upper corner of an endmost opening A1. The first portion 17A and the second portion 17B extend from a first free end edge of the blank 10 towards the endmost opening A1.

The first portion 17A is convergently arranged with respect to the fold line 15 that couples the first lower bevel panel 14 to the base panel 12. The second portion 17B is convergently arranged with respect to the fold line 15 that couples the first lower bevel panel 14 to the base panel 12. This may have the effect of tightening an end portion of the first lower bevel panel 14 and/or the first side panel 16 about an adjacent endmost article B whereby reducing the likelihood of unintentional egress of said endmost article B from the carton 90.

The fold line 17 comprises a third portion 17C extending between the endmost opening A1 and an adjacent opening A1. In the illustrated embodiment the adjacent opening A1 forms a second endmost opening A1.

The third portion 17C of fold line 17 is arcuate or curvilinear in shape, in other embodiments the third portion 17C of fold line 17 may be non-linear, for example formed from two or more contiguous linear sections which are divergently arranged with respect to each other. This may have the effect of tightening a portion of the first lower bevel panel 14 and/or the first side panel 16 disposed between the endmost opening A1 and an adjacent opening A1 such that said portion is tightened about the endmost article B and an adjacently disposed article B whereby securely locating said articles B within the carton 90.

The fold line 17 comprises a fourth portion 17D extending between the second endmost opening A1 a second, opposing, free end edge of the blank 10. The fourth portion 17D is convergently arranged with respect to the fold line 15 that couples first lower bevel panel 14 to the base panel 12. This may have the effect of tightening a second, opposing, end portion of the first lower bevel panel 14 and/or the first side panel 16 about a second adjacent endmost article B, disposed at a second opposing end of the carton 90, whereby reducing the likelihood of unintentional egress of the second endmost article B from the carton 90.

The openings A1 of the heel engagement structures in the second lower bevel panel 26 interrupt the fold line 29 that couples the second lower bevel panel 26 to the second side panel 24. The fold line 29 comprises a first portion 29A and a second portion 29B which converge towards an upper corner of an endmost opening A1 in the second lower bevel panel 26. The first portion 29A and the second portion 29B extend from a first free end edge of the blank 10 towards said endmost opening A1.

The first portion 29A is convergently arranged with respect to the fold line 31 that couples second lower bevel panel 26 to the securing panel 28. The second portion 29B is convergently arranged with respect to the fold line 31 that couples the second lower bevel panel 26 to the securing panel 28. This may have the effect of tightening an end portion of the second lower bevel panel 26 and/or the second side panel 24 about an adjacent endmost article B whereby reducing the likelihood of unintentional egress of said endmost article B from the carton 90.

The fold line 29 comprises a third portion 29C extending between the endmost opening A1 and an adjacent opening A1. In the illustrated embodiment the adjacent opening A1 forms a second endmost opening A1 at an opposing end of the carton 90.

The third portion 29C of fold line 29 is arcuate or curvilinear in shape, in other embodiments the third portion 29C of fold line 29 may be non-linear, for example formed from two or more contiguous linear sections which are divergently arranged with respect to each other. This may have the effect of tightening a portion of the second lower bevel panel 26 and/or the second side panel 24 disposed between the endmost opening A1 and the adjacent opening A1 such that said portion is tightened about the endmost article B and an adjacently disposed article B whereby securely locating said articles B within the carton 90.

The fold line 29 comprises a fourth portion 29D extending between the second endmost opening A1 a second, opposing, free end edge of the blank 10. The fourth portion 29D is convergently arranged with respect to the fold line 31 that couples the second lower bevel panel 26 to the securing panel 28. This may have the effect of tightening a second, opposing, end portion of the second lower bevel panel 26 and/or the second side panel 24 about a second, opposing, endmost article B whereby reducing the likelihood of unintentional egress of the second endmost article B from the carton 90.

Optionally, the first and second upper bevel panels 18, 22 may comprise at least one shoulder engagement structure for engaging with a shoulder or upper portion of an article B. The blank 10 illustrated in FIG. 1 comprises four shoulder engagement structures, each is provided for engaging a respective article B. Each of the shoulder engagement structures comprises an opening A2. The openings A2 are struck, at least, from one of the first and second upper bevel panels 18, 22. The openings A2 may be struck, in part, from one of the first and second upper bevel panels 18, 22 and in part from the one of the first and second side panels 16, 24. In other embodiments, the openings A2 may be struck from one of the first and second side panels 16, 24. The openings A2 may be struck in part from the top panel 20.

The shoulder engagement structures comprise protrusions formed from material which would otherwise form one of the first and second upper bevel panels 18, 22 or one of the first and second side panels 16, 24. The protrusions are integral with the top panel 20. The protrusions form a tab which is disposed proximate to the top of an article B, and may be considered to form a part of the top wall of the carton 90. The tabs protect the top of the article B above which they are located.

The openings A2 of the shoulder engagement structures in the first upper bevel panel 18 interrupt the fold line 19 that couples the first upper bevel panel 18 to the first side panel 16. The fold line 19 comprises a first portion 19A and a second portion 19B which converge towards a lower corner of an endmost opening A2. The first portion 19A and the second portion 19B extend from a first free end edge of the blank 10 towards the endmost opening A2.

The first portion 19A is convergently arranged with respect to the fold line 21, which couples first upper bevel panel 18 to the top panel 20. The second portion 19B is convergently arranged with respect to the fold line 21 that couples first upper bevel panel 18 to the top panel 20. This may have the effect of tightening an end portion of the first upper bevel panel 18 and/or the first side panel 16 about an adjacent endmost article B whereby reducing the likelihood of unintentional egress of said endmost article B from the carton 90.

The fold line 19 comprises a third portion 19C extending between the endmost opening A2 and an adjacent opening A2. In the illustrated embodiment the adjacent opening A2 forms a second endmost opening A2.

The third portion 19C of fold line 19 is arcuate or curvilinear in shape, in other embodiments the third portion 19C of fold line 19 may be non-linear, for example formed from two or more contiguous linear sections which are divergently arranged with respect to each other. This may have the effect of tightening a portion of the first upper bevel panel 18 and/or the first side panel 16 disposed between the endmost opening A2 and an adjacent opening A2 such that said portion is tightened about the endmost article B and an adjacently disposed article B whereby securely locating said articles B within the carton 90.

The fold line 19 comprises a fourth portion 19D extending between the second endmost opening A2 a second, opposing, free end edge of the blank 10. The fourth portion 19D is convergently arranged with respect to the fold line 21 that couples the first upper bevel panel 18 to the top panel 20. This may have the effect of tightening a second, opposing, end portion of the first upper bevel panel 18 and/or the first side panel 16 about a second adjacent endmost article B, disposed at a second opposing end of the carton 90, whereby reducing the likelihood of unintentional egress of the second endmost article B from the carton 90.

The openings A2 of the heel engagement structures in the second upper bevel panel 22 interrupt the fold line 27 that couples the second lower bevel panel 26 to the second panel 24. The fold line 27 comprises a first portion 27A and a second portion 27B which converge towards a lower corner of an endmost opening A2 in the second upper bevel panel 22. The first portion 27A and the second portion 27B extend from a first free end edge of the blank 10 towards said endmost opening A2.

The first portion 27A is convergently arranged with respect to the fold line 25, which couples second upper bevel panel 22 to the top panel 20. The second portion 27B is convergently arranged with respect to the fold line 25 that couples second upper bevel panel 22 to the top panel 20. This may have the effect of tightening an end portion of the second upper bevel panel 22 and/or the second side panel 24 about an adjacent endmost article B whereby reducing the likelihood of unintentional egress of said endmost article B from the carton 90.

The fold line 27 comprises a third portion 27C extending between the endmost opening A2 and an adjacent opening A2. In the illustrated embodiment the adjacent opening A2 forms a second endmost opening A2 at an opposing end of the carton 90.

The third portion 27C of fold line 27 is arcuate or curvilinear in shape, in other embodiments the third portion 27C of fold line 27 may be non-linear, for example formed from two or more contiguous linear sections which are divergently arranged with respect to each other. This may have the effect of tightening a portion of the second upper bevel panel 22 and/or the second side panel 24 disposed between the endmost opening A2 and the adjacent opening A2 such that said portion is tightened about the endmost article B and an adjacently disposed article B whereby securely locating said articles B within the carton 90.

The fold line 27 comprises a fourth portion 27D extending between the second endmost opening A2 a second, opposing, free end edge of the blank 10. The fourth portion 27D is convergently arranged with respect to the fold line 25 that couples the second upper bevel panel 22 to the top panel 20. This may have the effect of tightening a second, opposing, end portion of the second upper bevel panel 22 and/or the second side panel 24 about a second, opposing, endmost article B whereby reducing the likelihood of unintentional egress of the second endmost article B from the carton 90.

The blank 10 comprises a handle structure H1/H2. The handle structure H1/H2 comprises a first end panel 34*a* hingedly connected to the first side panel 16 by a fold line 33*a* and a first handle panel 1 hingedly connected to the first end panel 34*a* by a fold line 35*a*.

The first handle panel 1 comprises an upper panel part 42*a* (or handle section) having a pair of handle openings. The handle openings may be defined, at least in part, by a handle aperture A3. Each handle opening may be defined, at least in part, by a cushioning tab 52 hingedly connected along an upper edge thereof to the upper panel part 42*a* by a fold line 51.

The first handle panel 1 comprises adjacent collapsing sections 40*a* and 38*a* which may be considered to form a first pair of hinged panels. A first collapsing section 40*a* is hingedly connected along an upper edge thereof to the upper panel part 42*a* by a fold line 41*a*. A second collapsing section 38*a* is hingedly connected along an upper edge thereof to the first collapsing section 40*a* by a fold line 39*a*.

The first handle panel 1 comprises a lower panel part 36*a* (or partition section). The lower panel part 36*a* is hingedly connected along an upper edge thereof to the second collapsing section 38*a* by a fold line 37*a*. The lower panel part 36*a* is hingedly connected along a lower edge thereof to the first end panel 34*a* by a fold line 35*a*. The lower panel part 36*a* forms a partition panel separating the articles B in one row of articles B from an adjacent row of articles B.

The first handle panel 1 may comprise a recess R1 struck from a free side edge of the adjacent collapsing sections 40*a* and 38*a*. The recess R1 may be arcuate or curvilinear in shape.

The fold line 39*a* hinging the first collapsing section 40*a* to the second collapsing section 38*a* is interrupted by a pair of cut lines or severance lines 43*a*, 45*a*. A first cut line 43*a* may be arcuate or curvilinear in shape. A second cut line 45*a* may be substantially trapezoidal in shape. The first cut line 43*a* defines in part a first tab T1. The second cut line 45*a* defines in part a second tab T2.

Optionally, the handle structure H1/H2 comprises a second end panel 34*b* hingedly connected to the second side panel 24 by a fold line 33*b* and a second handle panel 2 hingedly connected to the second end panel 34*b* by a fold line 35*b*.

The second handle panel 2 comprises a second upper panel part 42*b* (or second handle section) having a pair of handle openings. The handle openings may be defined, at least in part, by a handle aperture A3. Each handle opening may be defined, at least in part, by a cushioning tab 52 hingedly connected along an upper edge thereof to the second upper panel part 42*b* by a fold line 51.

The second handle panel 2 comprises adjacent collapsing sections 40*b* and 38*b* which may be considered to form a second pair of hinged panels. A third collapsing section 40*b* is hingedly connected along an upper edge thereof to the second upper panel part 42*b* by a fold line 41*b*. A fourth collapsing section 38*b* is hingedly connected along an upper edge thereof to the third collapsing section 40*b* by a fold line 39*b*.

The second upper panel part 42*b* may reinforce the upper panel part 42*a* of the first handle panel 1. The second upper panel part 42*b* together with the upper panel part 42*a* of the first handle panel 1 form a two ply or layered structure.

The second handle panel 2 comprises a second lower panel part 36*b*. The second lower panel part 36*b* is hingedly connected along an upper edge thereof to the fourth collapsing section 38*b* by a fold line 37*b*. The second lower panel part 36*b* is hingedly connected along a lower edge thereof to the second end panel 34*b* by a fold line 35*b*.

The second handle panel 2 may comprise a second recess R2 struck from a free side edge of the adjacent collapsing sections 40*b* and 38*b*. The second recess R2 may be arcuate or curvilinear in shape.

The fold line 39*b* hinging the third collapsing section 40*b* to the fourth collapsing section 38*b* is interrupted by a pair of cut lines or severance lines 43*b*, 45*b*. A third cut line 43*b* may be arcuate or curvilinear in shape. A fourth cut line 45*b* may be substantially trapezoidal in shape. The third cut line 43*a* defines in part a third tab T3. The fourth cut line 45*b* defines in part a fourth tab T4.

The first and second handle panels 1, 2 may be generally wider in dimension than the first or second end panel 34*a*, 34*b* to which they are hinged. In this way the first and second handle panels 1, 2 substantially extend between the top wall 20 and the base wall 12 of the carton 90.

Figure 5:
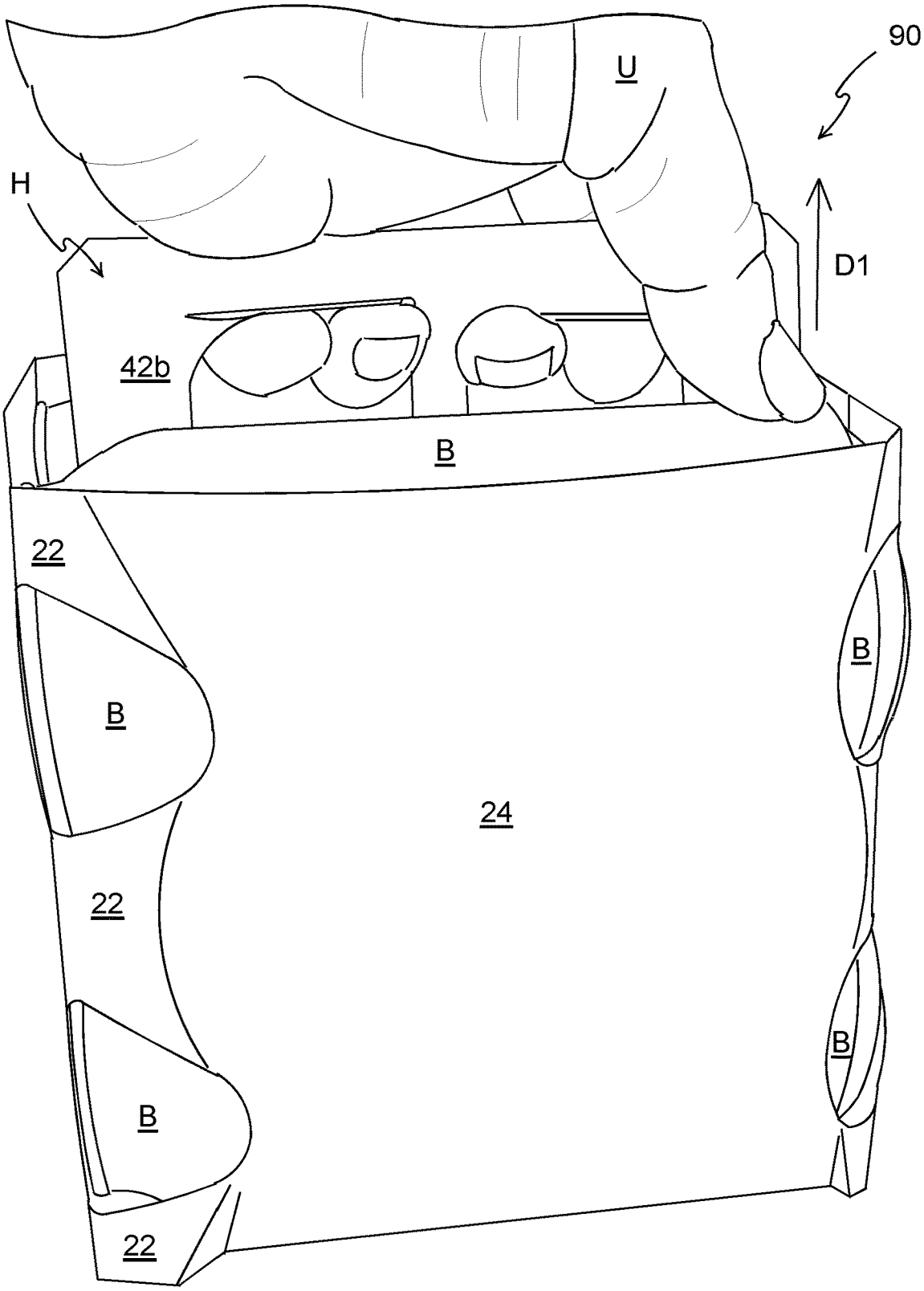
FIG. 5 is a perspective view of the carton of FIG. 2 showing the carrying handle in use.
Figure 6A:
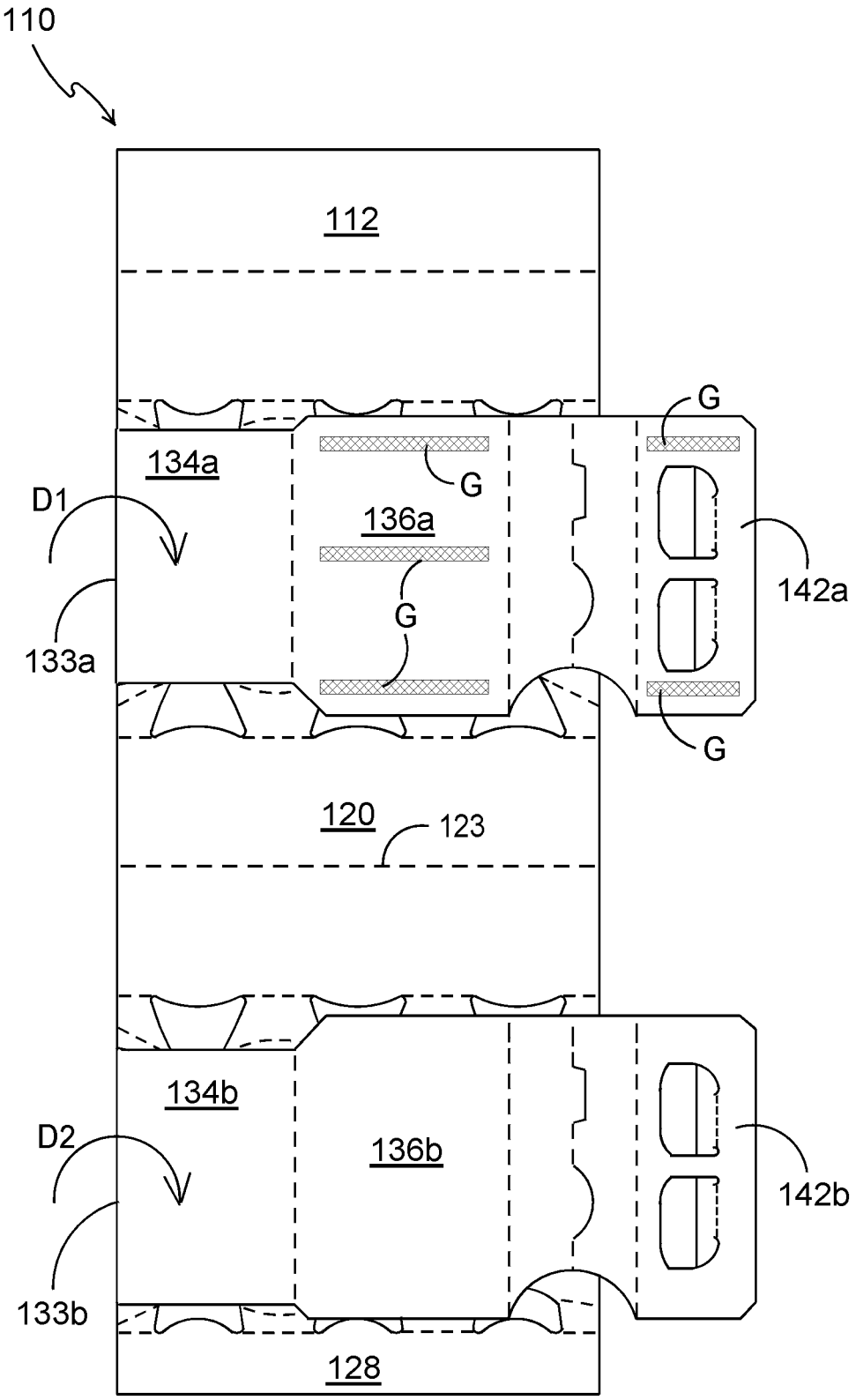
FIGS. 6A to 6C illustrate stages of forming a carton from the blank of FIG. 6.
Figure 6B:
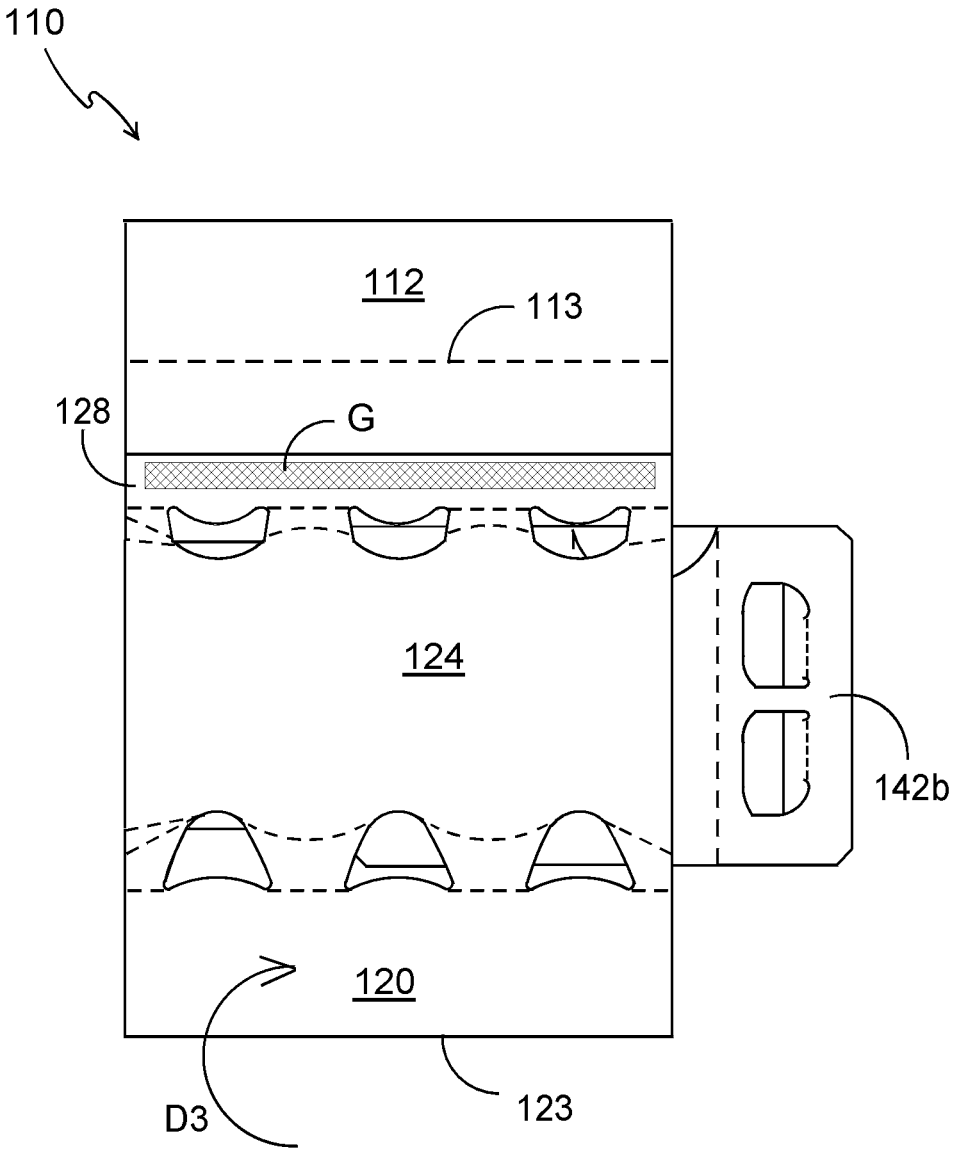
Figure 6C:
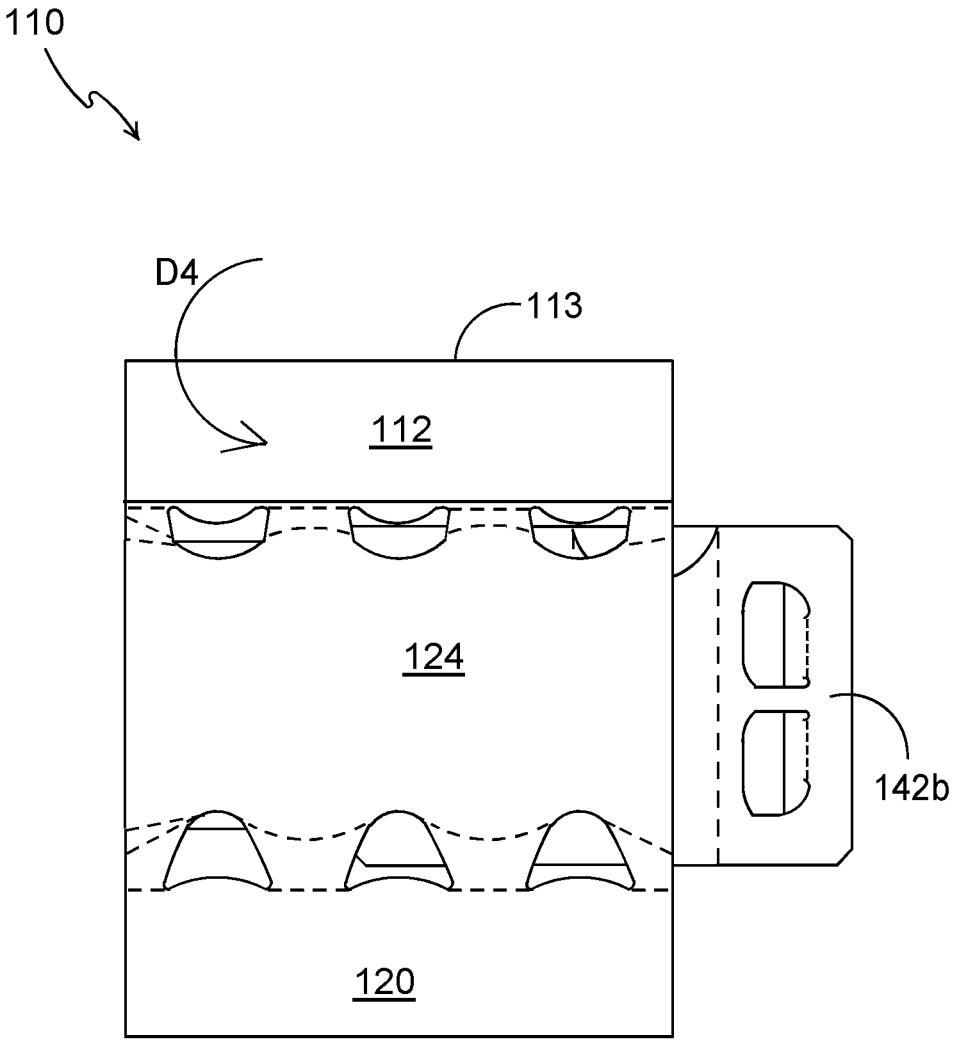

Referring now to FIGS. 6 to 6C there is shown an alternative embodiment of the present disclosure. In the alternative illustrated embodiment, like numerals have, where possible, been used to denote like parts, albeit with the addition of the prefix "100" to indicate that these features belong to the second embodiment. The second embodiment shares many common features with the embodiment of FIGS. 1 to 5 and therefore only the differences from the embodiment illustrated in FIGS. 1 to 5 will be described in any greater detail.

FIG. 6 illustrates a blank 110 for forming a carton 190 (see FIG. 6D) according to a second embodiment. The blank 110 comprises a plurality of main panels 112, 114, 116, 118, 120, 122, 124, 126, 128 for forming a tubular structure. The plurality of main panels 112, 114, 116, 118, 120, 122, 124, 126, 128 comprises a base panel 112, a first lower bevel panel 114, a first side panel 116, a first upper bevel panel 118, a top panel 120, a second upper bevel panel 122, a second side panel 124, a second lower bevel panel 126 and a securing panel 128. The plurality of panels 112, 114, 116, 118, 120, 122, 124, 126, 128 may be arranged in a linear series hinged one to the next by corresponding fold lines 115, 117, 119, 121, 125, 127, 129, 131.

The blank 110 is adapted to accommodate six articles B in a 2×3 arrangement. The blank 110 comprises six heel engagement structures each is provided for engaging a respective article B. Each of the heel engagement structures comprises an opening A1. The first lower bevel panel 114 comprises three openings A1.

A first central opening A1 is provided between the first and second endmost openings A1 in the first lower bevel panel 114. The first endmost opening A1 is coupled to the first central opening A1 by a third portion 117C of fold line 117 which couples the first lower bevel panel 114 to the first side panel 116. The third portion 117C of fold line 117 may be arcuate or curvilinear in shape.

The first central opening A1 is coupled to the second endmost opening A1 by a fifth portion 117E of fold line 117 which couples the first lower bevel panel 114 to the first side panel 116. The fifth portion 117E of fold line 117 may be arcuate or curvilinear in shape, in other embodiments the fifth portion 117E of fold line 117 may be non-linear, for example formed from two or more contiguous linear sections which are divergently arranged with respect to each other. This may have the effect of tightening a portion of the first lower bevel panel 114 and/or the first side panel 116 disposed between the second endmost opening A1 and the first central opening A1 such that said portion is tightened about the endmost article B and an adjacently disposed article B whereby securely locating said articles B within the carton 90.

The second lower bevel panel 126 comprises three openings A1.

A second central opening A1 is provided between the first and second endmost openings A1 in the second lower bevel panel 126. The first endmost opening A1 is coupled to the second central opening A1 by a third portion 129C of fold line 129 which couples the second lower bevel panel 126 to the second side panel 124. The third portion 129C of fold line 129 may be arcuate or curvilinear in shape.

The second central opening A1 is coupled to the second endmost opening A1 by a fifth portion 129E of fold line 129 which couples the second lower bevel panel 126 to the second side panel 124. The fifth portion 129E of fold line 129 may be arcuate or curvilinear in shape, in other embodiments the fifth portion 129E of fold line 129 may be non-linear, for example formed from two or more contiguous linear sections which are divergently arranged with respect to each other. This may have the effect of tightening a portion of the second lower bevel panel 126 and/or the second side panel 124 disposed between the second endmost opening A1 and the second central opening A1 such that said portion is tightened about the endmost article B and an adjacently disposed article B whereby securely locating said articles B within the carton 90.

The blank 110 comprises six shoulder engagement structures each is provided for engaging a respective article B. Each of the shoulder engagement structures comprises an opening A2. The first upper bevel panel 118 comprises three openings A2.

A first central opening A2 is provided between the first and second endmost openings A2 in the first upper bevel panel 118. The first endmost opening A2 is coupled to the first central opening A2 by a third portion 119C of fold line 119 which couples the first upper bevel panel 118 to the first side panel 116. The third portion 119C of fold line 119 may be arcuate or curvilinear in shape.

The first central opening A2 is coupled to the second endmost opening A2 by a fifth portion 119E of fold line 119 which couples the first upper bevel panel 118 to the first side panel 116. The fifth portion 119E of fold line 119 may be arcuate or curvilinear in shape, in other embodiments the fifth portion 119E of fold line 119 may be non-linear, for example formed from two or more contiguous linear sections which are divergently arranged with respect to each other. This may have the effect of tightening a portion of the first upper bevel panel 118 and/or the first side panel 116 disposed between the second endmost opening A2 and the first central opening A2 such that said portion is tightened about the endmost article B and an adjacently disposed article B whereby securely locating said articles B within the carton 90.

The second upper bevel panel 122 comprises three openings A2.

A second central opening A2 is provided between the first and second endmost openings A2 in the second upper bevel panel 122. The first endmost opening A2 is coupled to the second central opening A2 by a third portion 127C of fold line 127 which couples the second upper bevel panel 122 to the second side panel 124. The third portion 127C of fold line 127 may be arcuate or curvilinear in shape.

The second central opening A2 is coupled to the second endmost opening A2 by a fifth portion 127E of fold line 127 which couples the second upper bevel panel 122 to the second side panel 124. The fifth portion 127E of fold line 127 may be arcuate or curvilinear in shape, in other embodiments the fifth portion 127E of fold line 127 may be non-linear, for example formed from two or more contiguous linear sections which are divergently arranged with respect to each other. This may have the effect of tightening a portion of the second upper bevel panel 122 and/or the second side panel 124 disposed between the second endmost opening A2 and the second central opening A2 such that said portion is tightened about the endmost article B and an adjacently disposed article B whereby securely locating said articles B within the carton 90.

The blank 110 comprises a first handle panel 101 including a first lower panel part 136*a*. The first lower panel part 136*a* is longer in dimension than the first lower panel part 36*a* of the embodiment of FIG. 1; this accommodates the increase in length of the first side panel 116 due to the fact a greater number of articles B are being packaged. In this way, the upper panel part 142*a* of the first handle panel 101 is able to be disposed between the endmost articles B at the open end of the tubular structure formed by the main panels 112, 114, 116, 118, 120, 122, 124, 126, 128.

The second lower panel part 136*b* of the second handle panel 102 is similarly adjusted in length when provided.

Construction of the cartons 90; 190; 290; 390; 490 from the blanks 10; 110; 210; 310; 410 is substantially similar will now be described with reference to the embodiment illustrated in FIGS. 6 to 6D. The carton 190 (shown in FIG. 6D) can be formed from the blank 110 of FIG. 6 by a series of sequential folding operations in a straight line machine so that the blank 110 or carton 190 is not required to be rotated or inverted to complete its construction. The folding process is not limited to that described below and may be altered according to particular manufacturing requirements.

The first end panel 134*a* and the first handle panel 101 are folded together, with respect to the first side panel 116, about fold line 133*a* as indicated by direction arrow D1 in FIG. 6A. The first end panel 134*a* and the first lower panel part 134*a* are brought into face contacting relationship with the first side panel 116.

The second end panel 134*b* and the second handle panel 102 are folded together, with respect to the second side panel 124, about fold line 133*b* as indicated by direction arrow D2 in FIG. 6A. The second end panel 134*b* and the second lower panel part 134*b* are brought into face contacting relationship with the second side panel 124.

Glue G or other adhesive treatment is applied to an outer surface of the first lower panel part 134*a* and to an outer surface of the first upper panel part 142*a*. Alternatively, glue G or other adhesive treatment may be applied to an outer surface of the second lower panel part 134*b* and to an outer surface of the second upper panel part 142*b*.

The top panel 120 is folded, with respect to itself, about fold line 123 as indicated by direction arrow D3 in FIG. 6B. The second side panel 124 is brought into overlying registry with the first side panel 116. The second end panel 134*b* is disposed in face contacting relationship with first end panel 134*a*. The second upper panel part 142*b* and the second lower panel part 134*b* are disposed in face contacting relationship with first upper panel part 142*a* and the first lower panel part 134*a* respectively. The second upper panel part 142*b* is secured to first upper panel part 142*a*. The second lower panel part 134*b* is secured to the first lower panel part 134*a*.

Glue G or other adhesive treatment is applied to an outer surface of the securing panel 128. Alternatively, glue G or other adhesive treatment may be applied to an inner surface of a corresponding portion of the base panel 112.

The base panel 112 is folded with respect to itself, about fold line 113 as indicated by direction arrow D4 in FIG. 6C. A distal portion of the base panel 112 is brought into overlying registry with a proximal portion of the base panel 112. The distal portion of the base panel 112 is brought into face contacting relationship with the securing panel 128. The distal portion of the base panel 112 is secured to the securing panel 128.

The blank 110 is thus formed into a flat collapsed tubular structure which can be readily shipped or distributed to a convertor plant, at which the flat collapsed tubular structure may be erected into a tubular structure open at one end thereof and loaded with articles B through the open end.

The flat collapsed tubular structure may be erected to form an open-ended tubular structure by unfolding the top panel 120 and the base panel 112 about fold lines 123, 113 respectively. In doing the second side panel 124 is separated or spaced apart from the first side panel 116 to define an interior chamber divided by the first and second handle panel 101, 102.

The carton 190 is loaded with articles B through the open end thereof.

FIG. 2 illustrates a carton 90 formed from the blank 10 of FIG. 1. The carton 90 is shown with a carrying handle H (formed from the handle structures H1, H2) in a stowed condition. The carrying handle H is retracted within the interior of the tubular structure formed by the main panels 12, 14, 16, 18, 20, 22, 24, 26, 28 and is not visible in FIG. 2.

FIG. 5 illustrates the carrying handle H in a deployed condition. The carrying handle H is extended to pass through the open end of the tubular structure formed by the main panels 12, 14, 16, 18, 20, 22, 24, 26, 28 such that it can be readily grasped by a user. The handle opening A3 are disposed above the endmost articles B.

Figure 3:
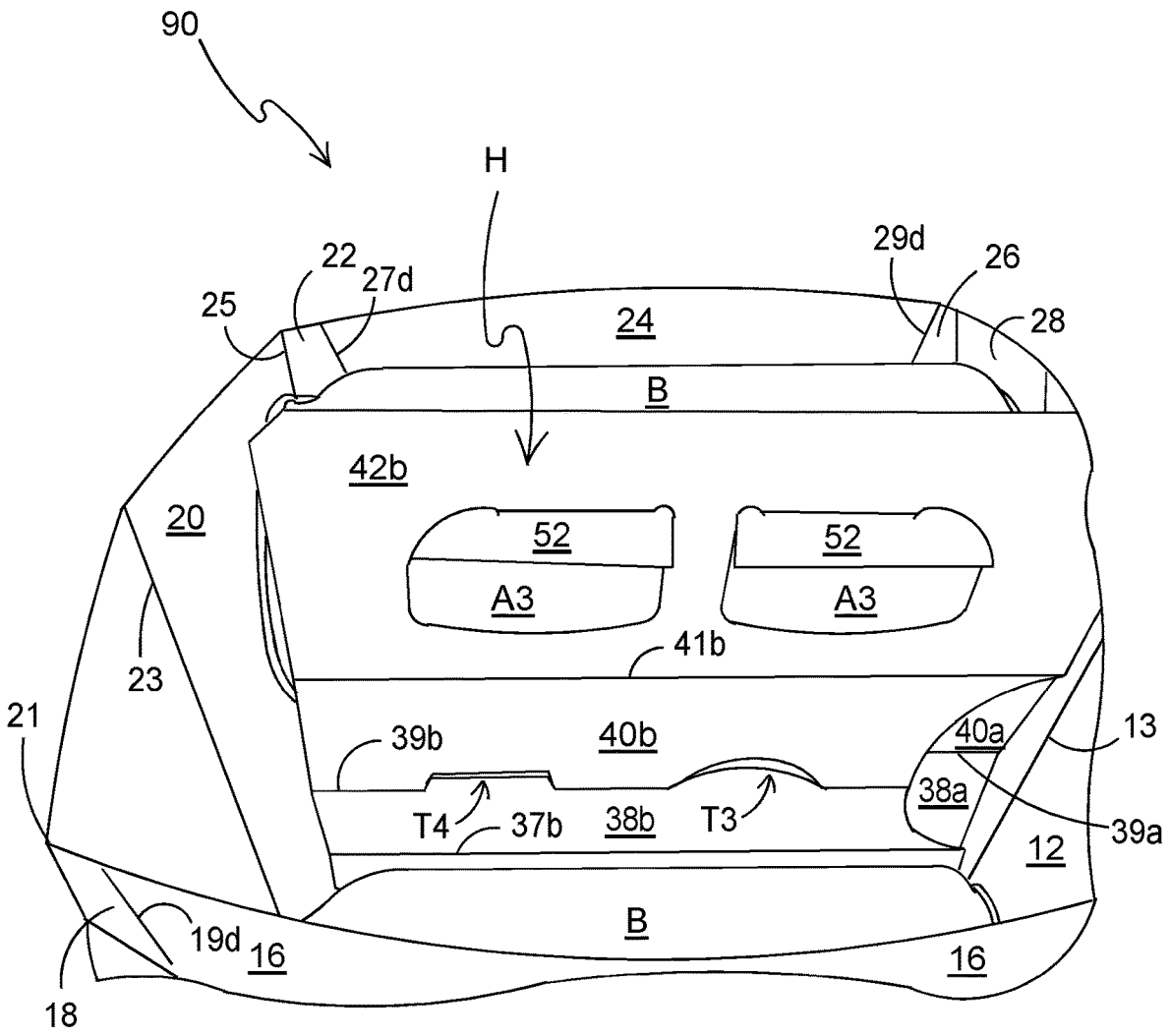
FIG. 3 is a perspective view of a portion of the carton of FIG. 2 showing a carrying handle in a deployed condition.
Figure 4:
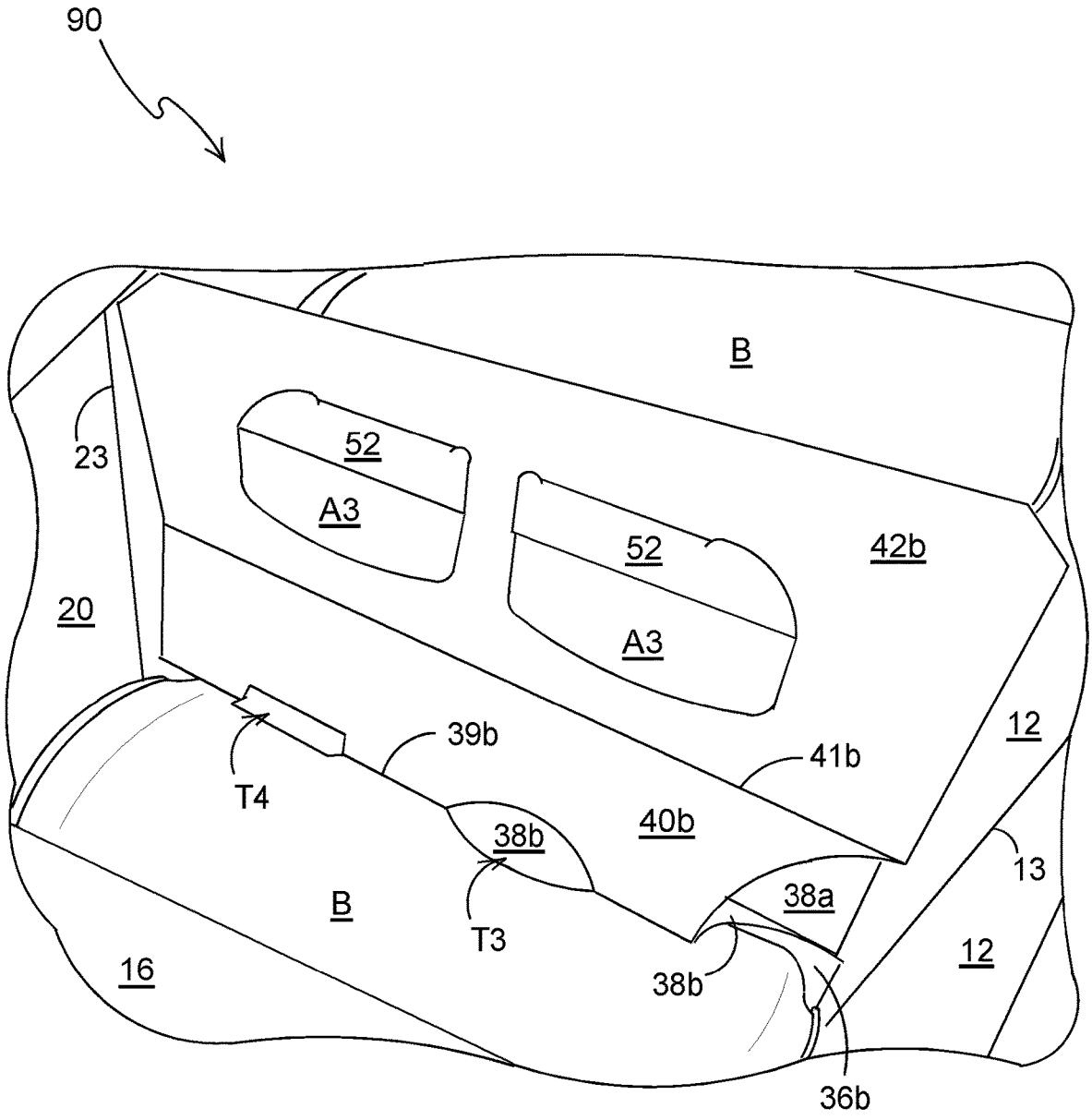
FIG. 4 is a perspective view of a portion of the carton of FIG. 2 showing the carrying handle in a stowed condition.

FIGS. 3 and 4 illustrate the carrying handle H in the stowed condition, one of the endmost cartons B has been removed for illustrative purposes. The collapsing sections 38*a*, 40*a* of the first handle panel 1 and the collapsing sections 38*b*, 40*b* of the second handle panel 2 are folded about fold lines 35*a*, 37*a*, 39*a*, 41*a* and fold lines 35*b*, 37*b*, 39*b*, 41*b* respectively.

The collapsing sections 38*a*, 40*a* of the first handle panel 1 and the collapsing sections 38*b*, 40*b* of the second handle panel 2 fold outwardly, away from each other to as to define a tubular formation or structure. The tubular formation comprises an axis which is perpendicular to the tubular axis of the tubular structure of an outer shell of the carton 90 formed by the main panels 12, 14, 16, 18, 20, 22, 24, 26, 28.

The tubular formation occupies a void between four adjacently disposed articles B. In this way the tubular formation may serve to stabilise the articles B when in the stowed condition. The collapsing sections 38*a*, 40*a*, 38*b*, 40*b* may brace the articles B, preventing or inhibiting movement of the articles B within the carton 90.

The upper panel parts 42*a*, 42*b* are disposed between a pair of adjacently disposed endmost articles B; the upper panel parts 42*a*, 42*b* may be sandwiched therebetween such that said articles B may pinch or squeeze the upper panel parts 42*a*, 42*b*. In this way the endmost articles B may frictionally engage the upper panel parts 42*a*, 42*b*. This frictional engagement may be overcome by user pulling upper panel parts 42*a*, 42*b* upwardly.

The lower panel parts 36*a*, 36*b* are disposed between a second pair of articles B disposed adjacent to the endmost articles B. In the embodiment of FIGS. 3 and 4 the second pair of articles B forms a pair of endmost articles at a second, opposing end of the carton 90. The lower panel parts 36*a*, 36*b* may be sandwiched therebetween such that said second pair of articles B may pinch or squeeze the lower panel parts 36*a*, 36*b*. In this way the endmost articles B may frictionally engage the lower panel parts 36*a*, 36*b*.

Figure 6D:
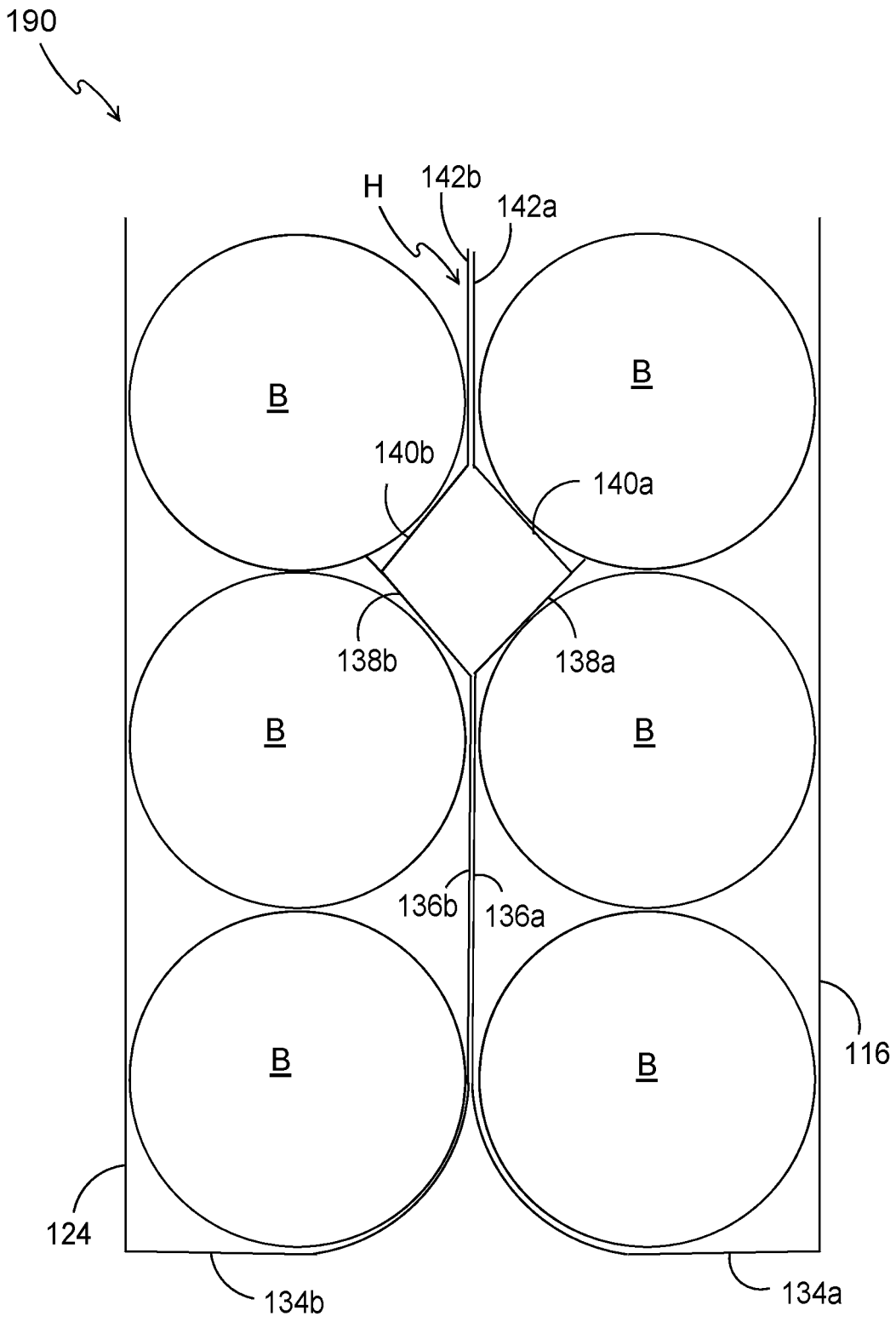
FIG. 6D is a sectional view of a carton formed from the blank of FIG. 6 showing a carrying handle in a stowed condition.

In the embodiment of FIGS. 6 to 6D, the carton 190 is shown with the carrying handle in a stowed condition in FIG. 6D. The lower panel parts 136*a*, 136*b* are disposed between a second pair of articles B disposed adjacent to the endmost articles B, the second pair of articles B forms a pair of central articles substantially in the middle of the carton 90. The lower panel parts 136*a*, 136*b* may be sandwiched between the second pair of articles B such that said articles B may pinch or squeeze the lower panel parts 136*a*, 136*b*. In this way the endmost articles B may frictionally engage the lower panel parts 136*a*, 136*b*. The lower panel parts 136*a*, 136*b* may also be disposed between a third pair of articles B disposed adjacent to the central articles B, the third pair of articles B may form a pair of endmost articles at a second, opposing end of the carton 90. The lower panel parts 136*a*, 136*b* may be sandwiched between the third pair of articles B such that said articles B may pinch or squeeze the lower panel parts 136*a*, 136*b*. In this way the third pair of articles B may frictionally engage the lower panel parts 136*a*, 136*b*.

Sandwiching the lower panel parts 36*a*, 36*b*; 136*a*, 136*b* in this way may prevent or restrict movement of the lower panel parts 36*a*, 36*b*; 136*a*, 136*b* and/or the end panels 34*a*, 34*b*; 134*a*, 134*b* downwardly when the carrying handle H is moved into the stowed condition.

The movement of the collapsing sections 38*a*, 40*a*; 138*a*, 140*a* of the first handle panel 1; 101 and the collapsing sections 38*b*, 40*b*; 138*b*, 140*b* of the second handle panel 2; 102, when the carrying handle H is being stowed away, may be restricted or limited by the adjacently disposed articles. In this way the tubular formation adopts a rhombus shaped cross-sectional shape best illustrated in FIG. 6D.

The cut lines 43*a*, 45*a*, 43*b*, 45*b*; 143*a*, 145*a*, 143*b*, 145*b* define tabs or protrusions T1, T2, T3, T4. The tabs T1, T2, T3, T4 are formed from material which would otherwise form the first collapsing section 40*a*; 140*a* or third collapsing section 40*b*; 140*b* respectively. The tabs T1, T2, are integral with the second collapsing section 38*a*; 138*a*. The tabs T3, T4 are integral with the fourth collapsing section 38*b*; 138*b*. The tabs T1, T2, T3, T4 serve to ensure the collapsing sections 38*a*, 40*a*; 138*a*, 140*a* of the first handle panel 1; 101 and the collapsing sections 38*b*, 40*b*; 138*b*, 140*b* of the second handle panel 2; 102 fold outwardly, away from each other to adopt a tubular formation. Folding the collapsing sections 38*a*, 40*a*; 138*a*, 140*a* of the first handle panel 1; 101 and the collapsing sections 38*b*, 40*b*; 138*b*, 140*b* of the second handle panel 2; 102 outwardly requires less force than folding in the opposing direction since the structure offer less resistance to folding in the outward direction.

Folding the collapsing sections 38*a*, 40*a*; 138*a*, 140*a* of the first handle panel 1; 101 or the collapsing sections 38*b*, 40*b*; 138*b*, 140*b* of the second handle panel 2; 102 in the opposite direction would require folding of the material provided by the respective tabs.

In this way the tabs T1, T2 defined, in part, by fold lines 43*a*, 45*a*; 143*a*, 145*a* serve to control the direction that the collapsing sections 38*a*, 40*a*; 138*a*, 140*a* of the first handle panel 1; 101 fold with respect to each other, similarly the tabs T3, T4 defined, in part, by fold lines 43*b*, 45*b*; 143*b*, 145*b* serve to control the direction that the collapsing sections 38*b*, 40*b*; 138*b*, 140*b* of the second handle panel 2; 102 fold.

The tabs T1, T2, T3, T4 form an expansion facilitator which guides or directs the collapsible tubular formation to fold or move so as to separate the collapsing sections 38*a*, 40*a*; 138*a*, 140*a* of the first handle panel 1 from the collapsing sections 38*b*, 40*b*; 138*b*, 140*b* of the second handle panel 2; 102.

The cut lines 43*a*, 45*a*, 43*b*, 45*b*; 143*a*, 145*a*, 143*b*, 145*b* are arranged such that the cut lines 43*a*, 45*a*; 143*a*, 145*a* may be offset with respect to the cut lines 43*b*, 45*b*; 143*b*, 145*b*. In this way the tabs T1, T2 formed in collapsing sections 38*a*, 40*a*; 138*a*, 140*a* of the first handle panel 1; 101 are misaligned or offset with respect to the tabs T3, T4 formed the collapsing sections 38*b*, 40*b*; 138*b*, 140*b* of the second handle panel 2; 102.

The tabs T1, T2, T3, T4 may be shaped and dimensioned such that at least one of the tabs T1, T2 provided by one of the collapsing sections 38*a*, 40*a*; 138*a*, 140*a* of the first handle panel 1; 101 or at least one of the tabs T3, T4 provided by one of the collapsing sections 38*b*, 40*b*; 138*b*, 140*b* of the second handle panel 2; 102 cannot pass through an opening in the collapsing sections 38*a*, 40*a*; 138*a*, 140*a*, 38*b*, 40*b*; 138*b*, 140*b* of the other of the first and second handle panels 1; 101, 2; 102. Said openings are created when each collapsing section 38*a*, 40*a*, 38*b*, 40*b*; 138*a*, 140*a*, 138*b*, 140*b* is folded, about a hinged connection (fold lines 39*a*, 39*b*, 139*a*, 139*b*), with respect to the adjacent collapsing section 38*a*, 40*a*, 38*b*, 40*b*; 138*a*, 140*a*, 138*b*, 140*b* to which it is hinged.

For example, the arcuate tab T1, defined by the cutline 43*a*; 143*a*, cannot pass through a trapezoidal opening created in the third collapsing section 40*b*, 140*b* and formed by displacement of the tab T4 out of the plane of the third collapsing section 40*b*, 140*b*, when the third collapsing section 40*b*, 140*b* is folded, about fold line 39*b*, 139*b*, with respect to the fourth collapsing section 38*b*, 138*b*.

Referring now to FIGS. 7 to 12 there is shown alternative embodiments of the present disclosure. In the alternative illustrated embodiments, like numerals have, where possible, been used to denote like parts, albeit with the addition of the prefix "200', "300", "400" to indicate that these features belong to the third, fourth and fifth embodiments respectively. The alternative embodiments share many common features with the embodiments of FIGS. 1 to 6D and therefore only the differences from the embodiment illustrated in FIGS. 1 to 6D will be described in any greater detail.

FIG. 7 illustrates a blank 210 according to a third embodiment. The blank 210 comprises a plurality of main panels 212, 214, 216, 218, 220, 222, 224, 226, 228 for forming a tubular structure. The plurality of main panels 212, 214, 216, 218, 220, 222, 224, 226, 228 comprises a base panel 212, a first lower bevel panel 214, a first side panel 216, a first upper bevel panel 218, a top panel 220, a second upper bevel panel 222, a second side panel 224, a second lower bevel panel 226 and a securing panel 228. The plurality of panels 212, 214, 216, 218, 220, 222, 224, 226, 228 may be arranged in a linear series hinged one to the next by corresponding fold lines 215, 217, 219, 221, 225, 227, 229, 231.

The blank 210 is adapted to accommodate two articles B in a 1×2 arrangement. The blank 210 comprises four heel engagement structures, opposing engagement structures engage the same article B. In this way each article B is engaged on opposing sides by a respective one of the heel engagement structures. Each of the heel engagement structures comprises an opening A1. The first lower bevel panel 214 comprises two openings A1. The second lower bevel panel 226 comprises two openings A1.

The blank 210 comprises four shoulder engagement structures, opposing shoulder structures engage the same article B. In this way each article B is engaged on opposing sides by a respective one of the shoulder engagement structures. Each of the shoulder engagement structures comprises an opening A2. The first upper bevel panel 218 comprises two openings A2. The second upper bevel panel 222 comprises two openings A2.

The blank 210 comprises only one end panel 234*b*. The first end panel 34*a*, 134*a* of the previous embodiments has been omitted. The end panel 234*b* is hingedly connected to the second side panel 224 by a fold line 233*b*.

The blank 210 comprises only one handle panel 202. The first handle panel 1; 101 of the previous embodiments has been omitted. The handle panel 202 is hingedly connected to the end panel 234*b* by a fold line 235*b*.

The top panel 220 is unitary or unfoldable with respect to itself, that is to say the fold line 23; 123 of the previous embodiments has been omitted.

The base panel 212 is unitary or unfoldable with respect to itself, that is to say the fold line 13; 113 of the previous embodiments has been omitted. The base panel 212 forms a base wall of the carton 290 in combination with the securing panel 228.

The lower panel part 236*b* of the handle panel 202 may be secured to the first side panel 216 in a set-up carton 90.

Figure 8:
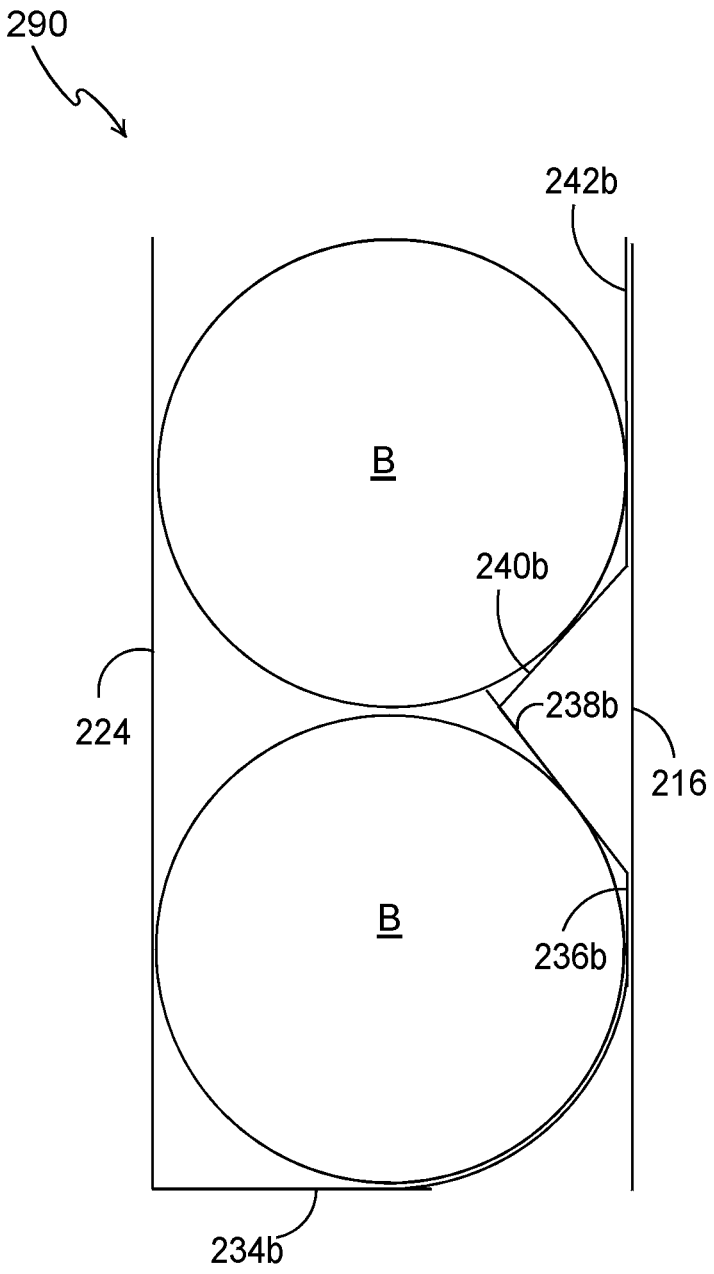
FIG. 8 is a sectional view of a carton formed from the blank of FIG. 7 showing a carrying handle in a stowed condition.

The handle structure H2 is disposed between the pair of articles B and the first side panel 216 as shown in FIG. 8.

The adjacent collapsing sections 240*a* and 238*a* fold with respect to each other and with respect to the respective one of the upper and lower panel parts 242*b*, 236*b* to which they are hinged. The adjacent collapsing sections 240*a* and 238*a* fold to occupy a void between the pair of articles B and the first side panel 216 in a collapsed or stowed condition. In the stowed condition the adjacent collapsing sections 240*a* and 238*a* define a "V' shape.

In order to deploy the handle structure H2 the upper panel part 242*b* may be pulled outwardly of the carton 90 through the open end of the tubular structure such that the adjacent collapsing sections 240*a* and 238*a* become substantially coplanar. The adjacent collapsing sections 240*a* and 238*a* become substantially coplanar with the upper and lower panel parts 242*b*, 236*b*. The adjacent collapsing sections 240*a* and 238*a* are brought into close proximity with the first side panel 216.

The lower panel part 236*b* may be secured to the first side panel 216.

FIG. 9 illustrates a blank 310 according to a third embodiment. The blank 310 comprises a plurality of main panels 312, 314, 316, 318, 320, 322, 324, 326, 328 for forming a tubular structure. The plurality of main panels 312, 314, 316, 318, 320, 322, 324, 326, 328 comprises a base panel 312, a first lower bevel panel 314, a first side panel 316, a first upper bevel panel 318, a top panel 320, a second upper bevel panel 322, a second side panel 224, a second lower bevel panel 326 and a securing panel 328. The plurality of panels 312, 314, 316, 318, 320, 322, 324, 326, 328 may be arranged in a linear series hinged one to the next by corresponding fold lines 315, 317, 319, 321, 325, 327, 329, 331.

The blank 310 is adapted to accommodate six articles B in a 2×3 arrangement. The blank 310 comprises six heel engagement structures three of which engage a first row of articles B and the remaining three engage a second row of articles B. The blank 310 comprises six shoulder engagement structures three of which engage the first row of articles B and the remaining three engage the second row of articles B.

The blank 310 comprises a handle structure H1/H2. The handle structure H1/H2 comprises a first end panel 334*a* hingedly connected to the first side panel 316 by a fold line 333*a* and a handle panel 301 hingedly connected to the first end panel 334*a* by a fold line 335*a*.

The handle panel 301 comprises an upper panel part 342*a* (or handle section) having a pair of handle openings. The handle openings may be defined, at least in part, by a handle aperture A3.

The handle panel 301 comprises adjacent collapsing sections 340*a* and 338*a*. A first collapsing section 340*a* is hingedly connected along an upper edge thereof to the upper panel part 342*a* by a fold line 341*a*. A second collapsing section 338*a* is hingedly connected along an upper edge thereof to the first collapsing section 340*a* by a fold line 339*a*.

The handle panel 301 comprises a lower panel part 336*a*. The lower panel part 336*a* is hingedly connected along an upper edge thereof to the second collapsing section 338*a* by a fold line 337*a*. The lower panel part 336*a* is hingedly connected along a lower edge thereof to the first end panel 334*a* by a fold line 335*a*.

The handle panel 301 may comprise a recess R1 struck from a free side edge of the adjacent collapsing sections 340*a* and 338*a*. The recess R1 may be arcuate or curvilinear in shape.

The fold line 339*a* hinging the first collapsing section 340*a* to the second collapsing section 338*a* is interrupted by a pair of cut lines or severance lines 343*a*, 345*a*. A first cut line 343*a* may be arcuate or curvilinear in shape. A second cut line 345*a* may be substantially trapezoidal in shape. The first cut line 343*a* defines in part a first tab T1. The second cut line 345*a* defines in part a second tab T2.

The handle structure H1/H2 comprises a second end panel 334*b* hingedly connected to the second side panel 324 by a fold line 333*b* and a second handle panel 302 hingedly connected to the second end panel 334*b* by a fold line 335*b*.

The second handle panel 302 comprises a second upper panel part 342*b* (or second handle section) having a pair of handle openings. The handle openings may be defined, at least in part, by a handle aperture A3.

The second handle panel 302 comprises adjacent collapsing sections 340*b* and 338*b*. A third collapsing section 340*b* is hingedly connected along an upper edge thereof to the second upper panel part 342*b* by a fold line 341*b*. A fourth collapsing section 338*b* is hingedly connected along an upper edge thereof to the third collapsing section 340*b* by a fold line 339*b*.

The second handle panel 302 comprises a second lower panel part 336*b*. The second lower panel part 336*b* is hingedly connected along an upper edge thereof to the fourth collapsing section 338*b* by a fold line 337*b*. The second lower panel part 336*b* is hingedly connected along a lower edge thereof to the second end panel 334*b* by a fold line 335*b*.

The second handle panel 302 may comprise a second recess R2 struck from a free side edge of the adjacent collapsing sections 340*b* and 338*b*. The second recess R2 may be arcuate or curvilinear in shape.

The fold line 339*b* hinging the third collapsing section 340*b* to the fourth collapsing section 338*b* is interrupted by a pair of cut lines or severance lines 343*b*, 345*b*. A third cut line 343*b* may be arcuate or curvilinear in shape. A fourth cut line 345*b* may be substantially trapezoidal in shape.

The third cut line 343*a* defines in part a third tab T3. The fourth cut line 345*b* defines in part a fourth tab T4. In the embodiment of FIG. 9 the third tab T3 is arranged to be aligned with the first tab T1 and the fourth tab T4 is arranged to be aligned with the second tab T2.

Figure 10:
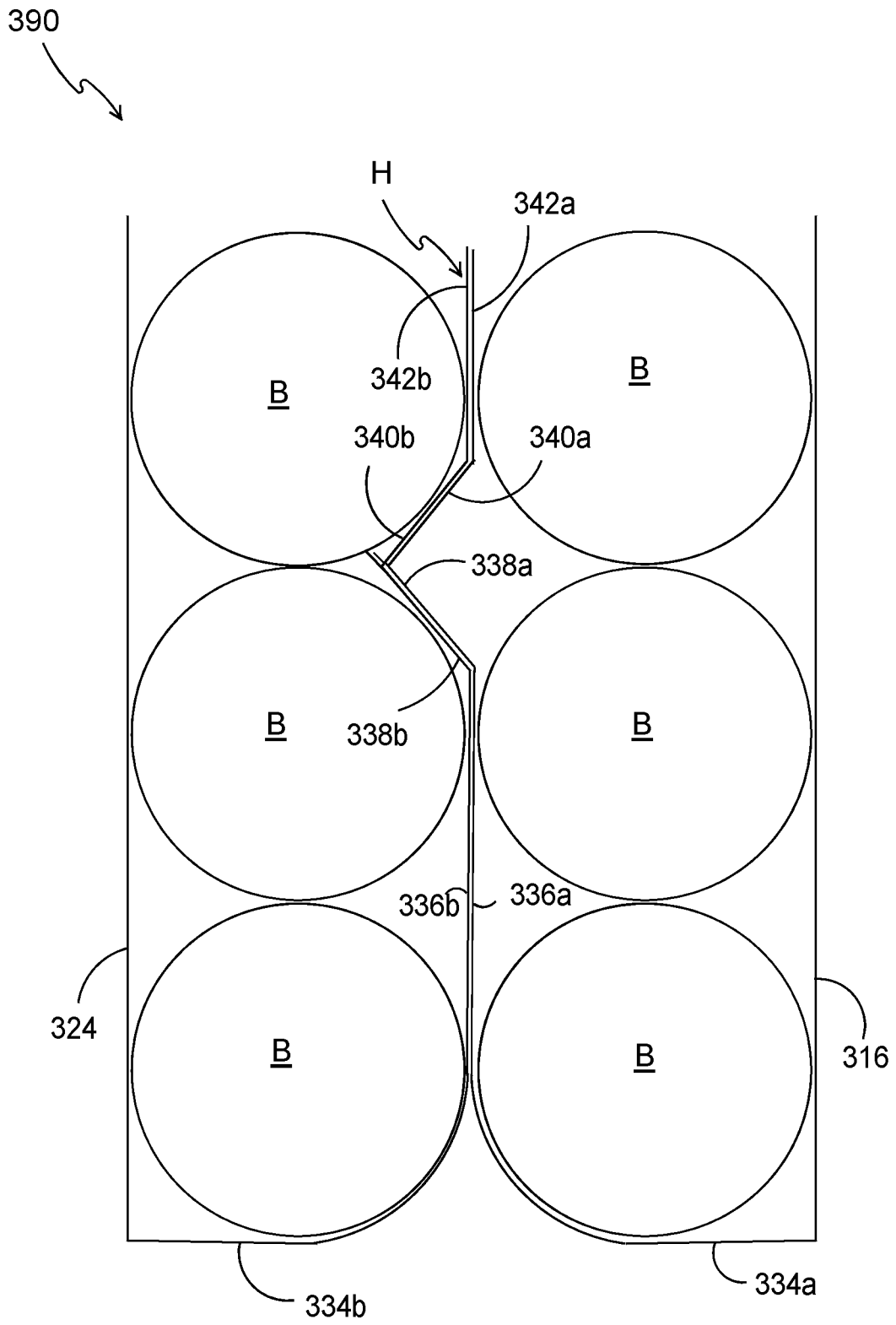
FIG. 10 is a sectional view of a carton formed from the blank of FIG. 9 showing a carrying handle in a stowed condition.

The first and second collapsing sections 340*a*, 338*a* are adapted to fold in the same direction as the third and fourth collapsing section 340*b*, 338*b*; that is to say rather than fold in the opposite as direction as the embodiments of FIGS. 1 to 6D, the first collapsing sections 340*a*, 338*a* fold inside the third and fourth collapsing sections 340*b*, 338*b*. In this way the first collapsing section 340*a* remains in face contacting relationship with the third collapsing section 340*b* and the second collapsing section 338*a* remains in face contacting relationship with the fourth collapsing section 338*b* when in the stowed condition, as illustrated in FIG. 10, and when in the deployed condition.

The cut lines 343*a*, 345*a*, 343*b*, 345*b* define tabs or protrusions T1, T2, T3, T4. The tabs T1, T2, T3, T4 are formed from material which would otherwise form the first collapsing section 340*a* or the third collapsing section 340*b* respectively. The tabs T1, T2, T3, T4 are integral with the second collapsing section 338*a* or with the fourth collapsing section 338*b*. The tabs T1, T2, T3, T4 serve to ensure the collapsing sections 338*a*, 340*a*; of the first handle panel 301 and the collapsing sections 338*b*, 340*b* of the second handle panel 302 fold together in the same direction to adopt a "V" shaped arrangement.

The cut lines 343*a*, 345*a*, 343*b*, 345*b* are arranged such that the first cut line 343*a* is aligned with respect to the third cut line 343*b* and the second cut line 345*a* is aligned with respect to the fourth cut line 345*b*. The first and third cut lines 343*a*, 343*b* have substantially the same shape albeit the first cut line 343*a* is dimensioned such that the tab T1 it defines is smaller than the tab T3 defined by the third cut line 343*b*. The second and fourth cut lines 345*a*, 345*b* have substantially the same shape albeit the second cut line 345*a* is dimensioned such that the tab T2 it defines is smaller than the tab T4 defined by the fourth cut line 345*b*. (In the embodiments of FIGS. 1 and 6 the first and third cut lines 343*a*, 343*b* are arranged so as to be misaligned when the first handle panel 1; 101 is disposed in face to face relationship with the second handle panel 2; 202; similarly the second and fourth cut lines 345*a*, 345*b* have are misaligned.)

In this way the tabs T1, T2 formed in collapsing sections 338*a*, 340*a*; of the first handle panel 101 can pass through a respective opening in the collapsing sections 338*b*, 340*b* of the second handle panel 302. Openings are created in the third collapsing section 340*b* when the collapsing sections 338*b*, 340*b* are folded with respect to each other about fold line 339*b*. The tabs T1, T2, defined by the cut lines 343*a*, 345*a*, in the collapsing sections 338*a*, 340*a* of the first handle panel 101 are smaller in dimension and are aligned with a corresponding opening, defined by a respective one of the cut lines 343*b*, 345*b*, in the third collapsing section 340*b*.

FIG. 11 illustrates a blank 410 according to a third embodiment. The blank 410 comprises a plurality of main panels 412, 414, 416, 418, 420, 422, 424, 426, 428 for forming a tubular structure. The plurality of main panels 412, 414, 416, 418, 420, 422, 424, 426, 428 comprises a base panel 412, a first lower bevel panel 414, a first side panel 416, a first upper bevel panel 418, a top panel 420, a second upper bevel panel 422, a second side panel 424, a second lower bevel panel 426 and a securing panel 428. The plurality of panels 412, 414, 416, 418, 420, 422, 424, 426, 428 may be arranged in a linear series hinged one to the next by corresponding fold lines 415, 417, 419, 421, 425, 427, 429, 431.

The blank 410 is adapted to accommodate six articles B in a 2×3 arrangement. The blank 410 comprises six heel engagement structures three of which engage a first row of articles B and the remaining three engage a second row of articles B. The blank 410 comprises six shoulder engagement structures three of which engage the first row of articles B and the remaining three engage the second row of articles B.

The blank 410 comprises a handle structure H1/H2. The handle structure H1/H2 comprises a first end panel 434*a* hingedly connected to the first side panel 416 by a fold line 433*a* and a first handle panel 401 hingedly connected to the first end panel 434*a* by a fold line 435*a*.

The handle structure H1/H2 comprises a second end panel 434*b* hingedly connected to the second side panel 424 by a fold line 433*b* and a second handle panel 402 hingedly connected to the second end panel 434*b* by a fold line 435*b*.

The second handle panel 402 comprises a second upper panel part 442*b* (or second handle section) having a pair of handle openings. The handle openings may be defined, at least in part, by a handle aperture A3.

The second handle panel 402 comprises adjacent collapsing sections 440*b* and 438*b*. A third collapsing section 440*b* is hingedly connected along an upper edge thereof to the second upper panel part 442*b* by a fold line 441*b*. A fourth collapsing section 438*b* is hingedly connected along an upper edge thereof to the third collapsing section 440*b* by a fold line 439*b*.

The second handle panel 402 comprises a second lower panel part 436*b*. The second lower panel part 436*b* is hingedly connected along an upper edge thereof to the fourth collapsing section 438*b* by a fold line 437*b*. The second lower panel part 436*b* is hingedly connected along a lower edge thereof to the second end panel 434*b* by a fold line 435*b*.

The second handle panel 402 may comprise a second recess R2 struck from a free side edge of the adjacent collapsing sections 440*b* and 438*b*. The second recess R2 may be arcuate or curvilinear in shape.

The first handle panel 401 comprises an upper panel part 456*a* (or handle section) having a pair of handle openings. The handle openings may be defined, at least in part, by a handle aperture A3. The upper panel part 456*a* of first handle panel 401 is longer in dimension than the upper panel part 442*b* of second handle panel 402.

The first handle panel 401 comprises adjacent collapsing sections 454*a* and 452*a*. A first collapsing section 454*a* is hingedly connected along an upper edge thereof to the upper panel part 456*a* by a fold line 457*a*. A second collapsing section 452*a* is hingedly connected along an upper edge thereof to the first collapsing section 454*a* by a fold line 455*a*.

The first handle panel 401 comprises a lower panel part 450*a*. The lower panel part 450*a* is hingedly connected along an upper edge thereof to the second collapsing section 452*a* by a fold line 453*a*. The lower panel part 450*a* is hingedly connected along a lower edge thereof to the first end panel 434*a* by a fold line 451*a*. The lower panel part 450*a* of first handle panel 401 is shorter in dimension than the lower panel part 436*b* of second handle panel 402, in this way the adjacent collapsing sections 454*a* and 452*a* of the first handle panel 401 are disposed in closer proximity to the first end panel 434*a* than the adjacent collapsing sections 440*b* and 438*b* of the second handle panel 402 are disposed to the second end panel 434*b*.

The first handle panel 401 may comprise a recess R1 struck from a free side edge of the adjacent collapsing sections 454*a* and 452*a*. The recess R1 may be arcuate or curvilinear in shape.

The fold line 455*a* hinging the first collapsing section 454*a* to the second collapsing section 452*a* is interrupted by a pair of cut lines or severance lines 443*a*, 445*a*. A first cut line 443*a* may be arcuate or curvilinear in shape. A second cut line 445*a* may be substantially trapezoidal in shape.

The fold line 441*b* hinging the third collapsing section 440*b* to the fourth collapsing section 438*b* is interrupted by a pair of cut lines or severance lines 443*b*, 445*b*. A third cut line 443*b* may be arcuate or curvilinear in shape. A fourth cut line 445*b* may be substantially trapezoidal in shape.

The third and fourth collapsing section 440*b*, 438*b* are adapted to fold in a first void between a first pair of endmost articles B, disposed adjacent the open end of the carton 490, and a second pair of articles B disposed adjacent to the first pair of articles B. The second pair of articles B is centrally located in the illustrated embodiment. The upper panel part 456*a* of the first handle panel 401 is unfolded in this first void and extends substantially straight or directly through the first void.

The first and second collapsing sections 454*a*, 452*a* are adapted to fold in a second void between a third pair of endmost articles B, disposed adjacent the closed end of the carton 490, and an adjacent pair of articles B. In the illustrated embodiment, the adjacent pair of articles B is the second or central pair of articles B. The lower panel part 436*a* of the second handle panel 402 is unfolded in this second void and extends substantially straight or directly through the second void.

The first and second collapsing sections 454*a*, 452*a* fold or collapse in a different void to that which the third and fourth collapsing section 440*b*, 438*b* fold or collapse in.

The first and second collapsing sections 454*a*, 452*a* fold in an opposing direction to the third and fourth collapsing section 440*b*, 438*b*. In this embodiment an upper portion of the lower panel part 436*b* is disposed in face to face relationship with a lower portion of the upper panel part 456*a*. The lower panel part 436*b* and upper panel part 456*a* are arranged in a sliding relationship with respect to each other. In this way the degree or amount of overlap between the lower panel part 436*b* and the upper panel part 456*a* increases when the carrying handle is in the stowed condition.

The present disclosure provides a carton 90; 190; 290; 390; 490 for packaging articles B. The carton 90; 190; 290; 390; 490 comprises plurality of walls 12, 14, 16, 18, 20, 22, 24, 26; 112, 114, 116, 118, 120, 122, 124, 126; 212, 214, 216, 218, 220, 222, 224, 226; 312, 314, 316, 318, 320, 322, 324, 326; 412, 414, 416, 418, 420, 422, 424, 426 including; a top wall 20; 120; 220; 320; 420, a first side wall 16; 116; 216; 316; 416, a second side wall 24; 124; 224; 324; 424 and a base wall 12; 112; 212; 312; 412. The plurality of walls 12, 14, 16, 18, 20, 22, 24, 26; 112, 114, 116, 118, 120, 122, 124, 126; 212, 214, 216, 218, 220, 222, 224, 226; 312, 314, 316, 318, 320, 322, 324, 326; 412, 414, 416, 418, 420, 422, 424, 426 forming a carton body.

The carton 90; 190; 290; 390; 490 comprises an extendible handle H, the handle is movable between a retracted position (stowed condition) to an extended position (deployed condition).

The handle H comprises at least one handle panel 42*a*, 42*b*; 142*a*, 142*b*; 342*a*, 342*b*; 456*a*, 442*b* and a collapsible structure 38*a*/40*a*/38*b*/40*b*; 138*a*/140*a*/138*b*/140*b*; 338*a*/340*a*/338*b*/340*b*; 452*a*/454*a*/438*b*/440*b*. The collapsible tubular structure 38*a*/40*a*/38*b*/40*b*; 138*a*/140*a*/138*b*/140*b*; 338*a*/340*a*/338*b*/340*b*; 452*a*/454*a*/438*b*/440*b* connects or couples the at least one handle panel 42*a*, 42*b*; 142*a*, 142*b*; 342*a*, 342*b*; 456*a*, 442*b* to the main body of the carton 90; 190; 390; 490. The collapsible tubular structure 38*a*/40*a*/38*b*/40*b*; 138*a*/140*a*/138*b*/140*b*; 338*a*/340*a*/338*b*/340*b*; 452*a*/454*a*/438*b*/440*b* comprises a first pair of hinged panels 38*a*, 40*a*; 138*a*, 140*a*; 338*a*, 340*a*; 452*a*, 445*a* and a second pair of hinged panels 38*b*, 40*b*; 138*b*, 140*b*; 338*b*, 340*b*; 438*b*, 440*b*. The first pair of hinged panels 38*a*, 40*a*; 138*a*, 140*a*; 338*a*, 340*a*; 452*a*, 445*a* comprising an inner panel 38*a*, 138*a*, 338*a*, 452*a* hingedly connected by a first fold line 39*a*; 139*a*, 339*a*; 455*a* to an outer panel 40*a*; 140*a*; 340*a*; 445*a*. The second pair of hinged panels 38*b*, 40*b*; 138*b*, 140*b*; 338*b*, 340*b*; 438*b*, 440*b* comprising an inner panel 38*b*, 138*b*, 338*b*, 438*b* hingedly connected by a second fold line 39*b*; 139*b*, 339*b*; 439*b* to an outer panel 40*b*; 140*b*; 340*b*; 440*b*. The inner panels 38*a*, 38*b*; 138*a*, 138*b*; 338*a*, 338*b*; 452*a*, 438*b* are hingedly connected to the main body of the carton 90; 190; 390; 490. The outer panels 40*a*, 40*b*; 140*a*, 140*b*; 340*a*, 340*b*; 454*a*, 440*b* are hingedly connected to the at least one handle panel 42*a*, 42*b*; 142*a*, 142*b*; 342*a*, 342*b*; 456*a*, 442*b*. The collapsible tubular structure 38*a*/40*a*/38*b*/40*b*; 138*a*/140*a*/138*b*/140*b*; 338*a*/340*a*/338*b*/340*b*; 452*a*/454*a*/438*b*/440*b* further comprises an expansion facilitator for facilitating separation movement of the first pair of hinged panels 38*a*, 40*a*; 138*a*, 140*a*; 338*a*, 340*a*; 452*a*, 445*a* from the second pair of hinged panels 38*b*, 40*b*; 138*b*, 140*b*; 338*b*, 340*b*; 438*b*, 440*b*. The expansion facilitator comprises at least one tab T1, T2, T3, T4 coupled to one of the inner panels 38*a*, 38*b*; 138*a*, 138*b*; 338*a*, 338*b*; 452*a*, 438*b* and outer panels 40*a*, 40*b*; 140*a*, 140*b*; 340*a*, 340*b*; 454*a*, 440*b* of each of the first 38*a*, 40*a*; 138*a*, 140*a*; 338*a*, 340*a*; 452*a*, 445*a* and second 38*b*, 40*b*; 138*b*, 140*b*; 338*b*, 340*b*; 438*b*, 440*b* pairs of hinged panels. The at least one tab T1, T2, of the first pair of hinged panels 38*a*, 40*a*; 138*a*, 140*a*; 338*a*, 340*a*; 452*a*, 445*a* interrupting the first fold line 39*a*; 139*a*, 339*a*; 455*a*, the at least one tab T3, T4 of the second pair of hinged panels 38*b*, 40*b*; 138*b*, 140*b*; 338*b*, 340*b*; 438*b*, 440*b* interrupting the second fold line 39*b*; 139*b*, 339*b*; 439*b*.

The carton body includes at least one partition panel 36*a*, 36*b*; 136*a*, 136*b*; 236*b*; 336*a*, 336*b*; 450*a*, 436*b* and at least one end panel 34*a*, 34*b*; 134*a*, 134*b*; 234*b*; 334*a*, 334*b*; 434*a*, 434*b*.

The at least one end panel 34*a*, 34*b*; 134*a*, 134*b*; 234*b*; 334*a*, 334*b*; 434*a*, 434*b* is hingedly connected to one of the first and second side walls 16; 116; 216; 316; 416, 24; 124; 224; 324; 424. The at least one partition panel 36*a*, 36*b*; 136*a*, 136*b*; 236*b*; 336*a*, 336*b*; 450*a*, 436*b* is hingedly connected to the at least one end panel 34*a*, 34*b*; 134*a*, 134*b*; 234*b*; 334*a*, 334*b*; 434*a*, 434*b*.

The present disclosure also provides a carton 90; 190; 290; 390; 490 having an extendible handle. The carton 90; 190; 290; 390; 490 comprises plurality of walls 12, 14, 16, 18, 20, 22, 24, 26; 112, 114, 116, 118, 120, 122, 124, 126; 212, 214, 216, 218, 220, 222, 224, 226; 312, 314, 316, 318, 320, 322, 324, 326; 412, 414, 416, 418, 420, 422, 424, 426 forming a carton body. The body of the carton 90; 190; 290; 390; 490 comprises an outer shell defining at least in part the interior of the carton 90; 190; 290; 390; 490 for receiving articles. The plurality of walls 12, 14, 16, 18, 20, 22, 24, 26; 112, 114, 116, 118, 120, 122, 124, 126; 212, 214, 216, 218, 220, 222, 224, 226; 312, 314, 316, 318, 320, 322, 324, 326; 412, 414, 416, 418, 420, 422, 424, 426 may include; a top wall 20; 120; 220; 320; 420, a first side wall 16; 116; 216; 316; 416, a second side wall 24; 124; 224; 324; 424 and a base wall 12; 112; 212; 312; 412. The handle H comprises at least one handle panel 42*a*, 42*b*; 142*a*, 142*b*; 242*b*; 342*a*, 342*b*; 456*a*, 442*b* and a collapsible structure 38*a*/40*a*/38*b*/40*b*; 138*a*/140*a*/138*b*/140*b*; 238*b*/240*b*; 338*a*/340*a*/338*b*/340*b*; 452*a*/454*a*/438*b*/440. The collapsible tubular structure 38*a*/40*a*/38*b*/40*b*; 138*a*/140*a*/138*b*/140*b*; 238*b*/240*b*; 338*a*/340*a*/338*b*/340*b*; 452*a*/454*a*/438*b*/440*b* comprises a pair of panels 38*a*/40*a*, 38*b*/40*b*; 138*a*/140*a*, 138*b*/140*b*; 238*b*/240*b*; 338*a*/340*a*, 338*b*/340*b*; 452*a*/445*a*, 438*b*/440*b* including an inner panel 38*a*, 38*b*; 138*a*, 138*b*; 238*b*; 338*a*, 338*b*; 452*a*, 438*b* hingedly connected by a fold line 39*a*, 39*b*; 139*a*, 139*b*; 239*b*; 339*a*, 339*b*; 455*a*, 439*b* to an outer panel 40*a*, 40*b*; 140*a*, 140*b*; 240*b*; 340*a*, 340*b*; 454*a*, 440*b*. The inner panel 38*a*, 38*b*; 138*a*, 138*b*; 238*b*; 338*a*, 338*b*; 452*a*, 438*b* is hingedly connected to the main body of the carton 90; 190; 290; 390; 490 by a hinged connection 37*a*, 37*b*; 137*a*, 137*b*; 237*b*; 337*a*, 337*b*; 455*a*, 437*b*. The outer panel 40*a*, 40*b*; 140*a*, 140*b*; 240*b*; 340*a*, 340*b*; 454*a*, 440*b* is hingedly connected to the at least one handle panel 42*a*, 42*b*; 142*a*, 142*b*; 242*b*; 342*a*, 342*b*; 456*a*, 442*b*. The hinged connection 37*a*, 37*b*; 137*a*, 137*b*; 237*b*; 337*a*, 337*b*; 455*a*, 437*b* between the inner panel 38*a*, 38*b*; 138*a*, 138*b*; 238*b*; 338*a*, 338*b*; 452*a*, 438*b* and the carton body is disposed inside the interior of the carton 90; 190; 290; 390; 490 such that the collapsible structure 38*a*/40*a*/38*b*/40*b*; 138*a*/140*a*/138*b*/140*b*; 238*b*/240*b*; 338*a*/340*a*/338*b*/340*b*; 452*a*/454*a*/438*b*/440*b* may be brought into engagement with one or more articles B in the carton 90; 190; 290; 390; 490 when the handle H is in a retracted position.

The collapsible tubular structure defines a tubular axis, the at least one tab T1, T2, of the first pair of hinged panels 38*a*, 40*a*; 138*a*, 140*a*; 338*a*, 340*a*; 452*a*, 445*a* may be offset in the direction of the tubular axis from the at least one tab T3, T4 of the second pair of hinged panels 38*b*, 40*b*; 138*b*, 140*b*; 338*b*, 340*b*; 438*b*, 440*b*.

The at least one tab T1, T2, of the first pair of hinged panels 38*a*, 40*a*; 138*a*, 140*a*; 338*a*, 340*a*; 452*a*, 445*a* may be joined to, or integral with, the inner panel 38*a*, 138*a*, 338*a*, 452*a* of the first pair of hinged panels 38*a*, 40*a*; 138*a*, 140*a*; 338*a*, 340*a*; 452*a*, 445*a*, and the at least one tab T3, T4 of the second pair of hinged panels 38*b*, 40*b*; 138*b*, 140*b*; 338*b*, 340*b*; 438*b*, 440*b* may be joined to, or integral with, the inner panel 38*b*, 138*b*, 338*b*, 438*b* of the second pair of hinged panels 38*b*, 40*b*; 138*b*, 140*b*; 338*b*, 340*b*; 438*b*, 440*b*. In some embodiments, the at least one tab T3, T4 of the second pair of hinged panels 38*b*, 40*b*; 138*b*, 140*b*; 338*b*, 340*b*; 438*b*, 440*b* may be joined to, or integral with, the outer panel 40*b*; 140*b*; 340*b*; 440*b* of the second pair of hinged panels 38*b*, 40*b*; 138*b*, 140*b*; 338*b*, 340*b*; 438*b*, 440*b*.

The hinged connection 37*a*, 37*b*; 137*a*, 137*b*; 237*b*; 337*a*, 337*b*; 455*a*, 437*b* may be disposed below an upper edge of a section of the carton forming the outer shell when the handle H is in use. The upper edge may be a free edge at an open end of the outer shell-forming section.

The collapsible structure 38*a*/40*a*/38*b*/40*b*; 138*a*/140*a*/138*b*/140*b*; 238*b*/240*b*; 338*a*/340*a*/338*b*/340*b*; 452*a*/454*a*/438*b*/440*b* may be disposed in a space or void between two adjacent articles B when the handle H is in the retracted position.

The collapsible structure 38*a*/40*a*/38*b*/40*b*; 138*a*/140*a*/138*b*/140*b*; 238*b*/240*b*; 338*a*/340*a*/338*b*/340*b*; 452*a*/454*a*/438*b*/440*b* comprises an article engaging feature for locking the handle in the retracted position.

The article engaging feature may take the form of at least one engaging tab T1, T2, T3, T4 joined to the inner panel 38*a*, 38*b*; 138*a*, 138*b*; 238*b*; 338*a*, 338*b*; 452*a*, 438*b*. The article engaging feature may take the form of at least one embossment protruding from the outer panel 40*a*, 40*b*; 140*a*, 140*b*; 240*b*; 340*a*, 340*b*; 454*a*, 440*b*. The article engaging feature may take the form of at least one dot or strip of friction material, such as but not limited to fugitive glue or friction tape, on the outer panel 40*a*, 40*b*; 140*a*, 140*b*; 240*b*; 340*a*, 340*b*; 454*a*, 440*b*.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton comprising an extendible handle, the handle comprising at least one handle panel and a collapsible structure, the collapsible structure comprising a first pair of hinged panels, the first pair of hinged panels comprising an inner panel hingedly connected by a first fold line to an outer panel, wherein the inner panel is disposed between the outer panel and a main body of the carton, and the outer panel is hingedly connected to the at least one handle panel, the carton further comprising a cooperative feature disposed alongside the first pair of hinged panels, the collapsible structure further comprising an expansion facilitator for facilitating separation movement of the first pair of hinged panels from the cooperative feature, the expansion facilitator comprising at least one tab coupled to one of the first pair of hinged panels, the at least one tab of the first pair of hinged panels interrupting the first fold line.

2. A carton according to claim 1 wherein the main body comprises a plurality of walls including: a top wall, a first side wall, a second side wall and a base wall.

3. A carton according to claim 2 wherein the handle further comprises at least one end panel that is hingedly connected to one of the first and second side walls.

4. A carton according to claim 3 wherein the handle further comprises at least one partition panel hingedly connecting between the at least one end panel and the inner panel.

5. A carton according to claim 2 wherein the at least one handle panel and the collapsible structure are disposed alongside an inside surface of one of the first and second side walls and wherein the cooperative feature comprises a part of the one of the first and second side walls.

6. A carton according to claim 1 wherein the at least one handle panel s movable between a retracted position and an extended position.

7. A carton according to claim 1 wherein the at least one handle panel comprises first and second handle panels wherein the first handle panel is hingedly connected to the outer panel, wherein the collapsible structure further comprises a second pair of hinged panels, and wherein the cooperative feature comprises the second pair of hinged panels.

8. A carton according to claim 7 wherein the first and second pairs of hinged panels forms a tubular structure which defines a tubular axis, the expansion facilitator further comprises at least one tab coupled to one of the second pair of hinged panels, and the at least one tab of the first pair of hinged panels is offset in the direction of the tubular axis from the at least one tab of the second pair of hinged panels.

9. A carton according to claim 8 wherein the at least one tab of the second pair of hinged panels is either joined to or integral with the inner panel of the second pair of hinged panels.

10. A carton according to claim 8 wherein the at least one tab of the second pair of hinged panels is either joined to or integral with the outer panel of the second pair of hinged panels.

11. A carton according to claim 1 wherein the at least one tab of the first pair of hinged panels is either joined to or integral with the inner panel of the first pair of hinged panels.

12. A carton according to claim 1 wherein the at least one handle panel comprises first and second handle panels, wherein the first handle panel is hingedly connected to the outer panel, and wherein the cooperative feature comprises a part of the second handle panel.

13. A carton having an extendible handle, the carton comprising a plurality of walls forming a main body, the main body comprising an outer shell defining at least in part an interior of the carton for receiving articles, the handle comprising at least one handle panel and a collapsible structure, the collapsible structure comprising a pair of panels including an inner panel hingedly connected by a fold line to an outer panel, the inner panel being hingedly connected by a hinged connection to a partition panel within the interior of the carton, the outer panel being hingedly connected to the at least one handle panel, the hinged connection being disposed inside the interior of the carton such that the collapsible structure may be brought into engagement with one or more articles in the carton when the handle is in a retracted position.

14. A carton according to claim 13 wherein the plurality of walls includes: a top wall, a first side wall, a second side wall and a base wall.

15. A carton according to claim 13 wherein the hinged connection is disposed below an upper edge of the outer shell when the handle is in use.

16. A carton according to claim 15 wherein the upper edge is a free edge at an open end of the outer shell.

17. A carton according to claim 13 wherein the collapsible structure is disposed in a space or void between two adjacent articles when the handle is in the retracted position.

18. A carton according to claim 13 wherein the collapsible structure comprises an article engaging feature for locking the handle in the retracted position.

19. A carton according to claim 17 wherein the article engaging feature comprises one of the elements selected from the group consisting of: at least one engaging tab; at least one embossment protruding from the outer panel; at least one dot or strip of friction material on the outer panel; fugitive glue on the outer panel; and friction tape on the outer panel.

20. A blank for forming a carton, the blank comprising a plurality of panels forming a main body of the carton and defining at least part of an interior of the carton in a set-up condition, the plurality of panels including; a top panel, a first side panel, a second side panel and a base panel, the blank comprising an extendible handle, the handle comprising at least one handle panel and a collapsible structure, the collapsible structure coupling the at least one handle panel to a partition panel which is disposed within the interior of the carton in the set-up condition, the collapsible structure comprising a first pair of hinged panels, the first pair of hinged panels comprising an inner panel hingedly connected by a first fold line to an outer panel, wherein the inner panel is hingedly connected to the partition panel, the outer panel is hingedly connected to the at least one handle panel, and the blank further comprising a cooperative feature which is disposed alongside the first pair of hinged panels in the set-up condition, wherein the collapsible structure further comprises an expansion facilitator for facilitating separation movement of the first pair of hinged panels from the cooperative feature, the expansion facilitator comprises at least one tab coupled to one of the first pair of hinged panels, wherein the at least one tab of the first pair of hinged panels interrupts the first fold line.

* * * * *